US009943118B2

(12) United States Patent
Grzesik

(10) Patent No.: US 9,943,118 B2
(45) Date of Patent: Apr. 17, 2018

(54) UNDERGARMENTS WITH EQUILATERAL DIMENSIONS

(71) Applicant: Dustin Grzesik, Emeryville, CA (US)

(72) Inventor: Dustin Grzesik, Emeryville, CA (US)

( * ) Notice: Subject to any disclaimer, the term of this patent is extended or adjusted under 35 U.S.C. 154(b) by 284 days.

(21) Appl. No.: 14/796,998

(22) Filed: Jul. 10, 2015

(65) Prior Publication Data

US 2016/0007656 A1 Jan. 14, 2016

Related U.S. Application Data

(60) Provisional application No. 62/023,579, filed on Jul. 11, 2014.

(51) Int. Cl.
*A41B 9/00* (2006.01)

(52) U.S. Cl.
CPC ..... *A41B 9/001* (2013.01); *A41B 2400/44* (2013.01)

(58) Field of Classification Search
CPC ..... A41B 9/001; A41B 9/008; A41B 9/14
USPC ..... 2/400; 128/284, 287, 288, 291
See application file for complete search history.

(56) References Cited

U.S. PATENT DOCUMENTS

| | | | | |
|---|---|---|---|---|
| 341,382 | A | 5/1886 | Howell | |
| 3,413,824 | A | 8/1968 | Kuney | |
| 4,121,305 | A | 10/1978 | Kolker | |
| 4,481,683 | A | 11/1984 | Estruch | |
| 4,538,615 | A * | 9/1985 | Pundyk | A41C 1/003 450/131 |
| 5,398,346 | A * | 3/1995 | Feinberg | A41B 9/004 2/400 |
| 5,546,608 | A * | 8/1996 | Russano | A41B 9/008 2/406 |
| 5,819,323 | A * | 10/1998 | Edenfield | A41B 9/02 2/403 |
| 6,430,753 | B2 | 8/2002 | Duran | |
| 6,651,463 | B2 | 11/2003 | Bonnin | |
| 6,874,337 | B2 | 4/2005 | Uno et al. | |
| 7,143,453 | B2 | 12/2006 | Duran | |
| 2011/0023216 | A1* | 2/2011 | O'Leary | A41B 9/001 2/400 |
| 2012/0284895 | A1* | 11/2012 | Pace | A41D 27/08 2/69 |
| 2013/0198940 | A1 | 8/2013 | Cassoli | |
| 2015/0272789 | A1* | 10/2015 | Long | A61F 13/49011 604/385.3 |

* cited by examiner

*Primary Examiner* — Katherine Moran
(74) *Attorney, Agent, or Firm* — Lincoln Law School of San Jose

(57) ABSTRACT

An undergarment includes a main body comprising at least one panel of material, three openings having substantially equal dimensions, and three peripheral edges, where one peripheral edge is located between adjacent openings.

17 Claims, 25 Drawing Sheets

SIDE B

UNDERGARMENTS WITH EQUILATERAL DIMENSIONS

RELATED APPLICATIONS

This application claims priority to Provisional U.S. Appl. No. 62/023,579 filed on Jul. 11, 2014, which is herein incorporated by reference.

FIELD OF INVENTION

The present invention relates to undergarments, and more particularly, this invention relates to undergarments having equilateral dimensions.

BACKGROUND

Undergarments for both women and men are well known in the art. Typical undergarments include smaller openings configured to fit the legs of a human wearer, and a larger opening configured to fit the torso of a human wearer. Accordingly, properly donning conventional undergarments often requires a certain degree of attention and coordination on the part of the human wearer. For instance, a human wearer needs to properly orient a conventional undergarment prior to donning said undergarment by ensuring that the smaller openings are positioned so as to receive his/her legs and the larger opening is positioned so as to receive his/her torso. This may be problematic for small children; the elderly; people with disabilities, limited coordination and/or limited mobility; people needing to dress quickly and/or in limited or no light, etc. Moreover, as conventional undergarments have a particular orientation, said garments may deteriorate unevenly and require early replacement when portions thereof are damaged.

There are several additional disadvantages associated with conventional undergarments. For example, conventional undergarments often include unnecessary and/or complicated flaps or features that are not used by the human wearer. Furthermore, the manufacture of conventional undergarments may not be efficient or cost effective given the varying dimensions of said undergarments (e.g., the different sized openings, a larger sized rear fabric panel configured to conform to a portion of the buttocks of a human wearer, etc.). Likewise, the manufacture of gender specific conventional undergarments generally requires double inventory of materials for institutional use.

SUMMARY

An undergarment includes a main body comprising at least one panel of material, three openings having substantially equal dimensions, and three peripheral edges, where one peripheral edge is located between adjacent openings.

Other aspects and advantages of the present invention will become apparent from the following detailed description, which, when taken in conjunction with the drawings, illustrate by way of example the principles of the invention.

Figure 1A:
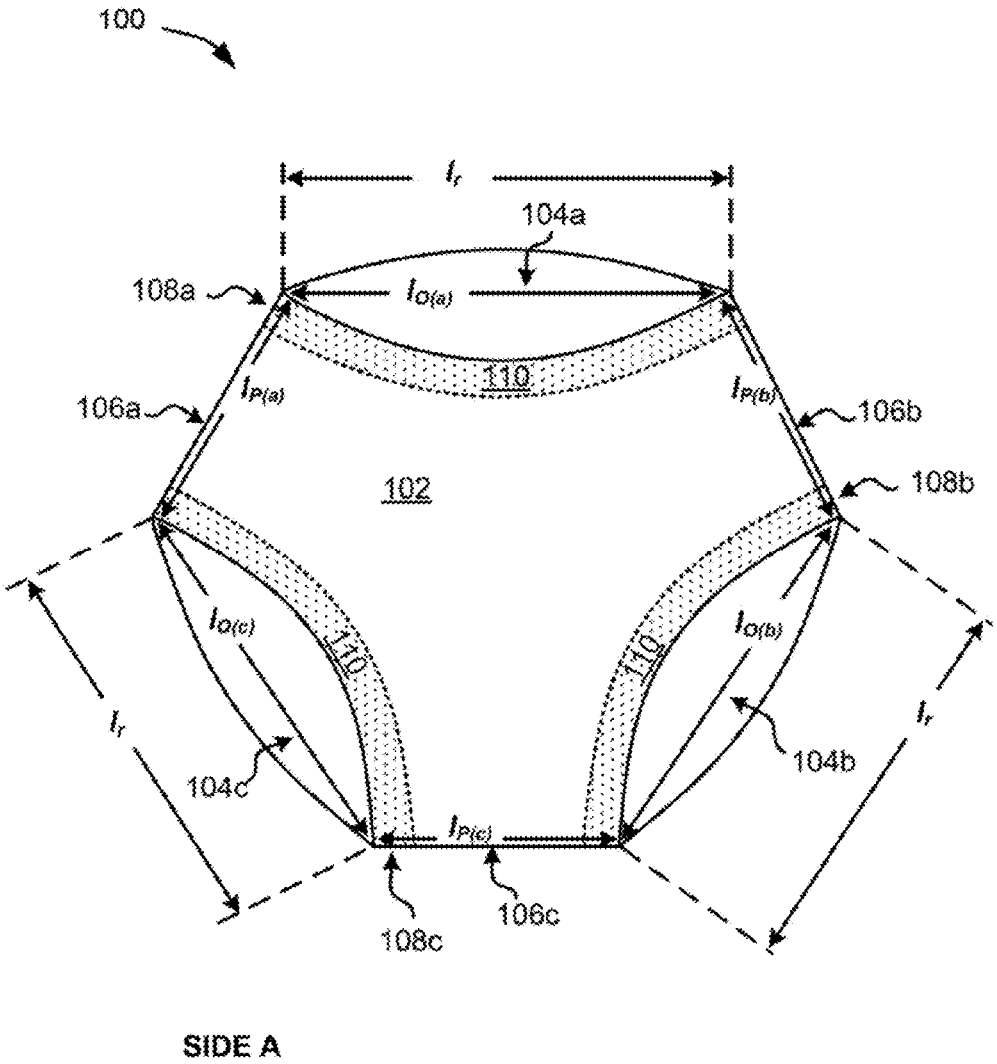
FIGS. 1A-1B are schematic representations illustrating two sides of an undergarment 100, according to one embodiment.

Reference should be made to the following detailed description, which when read in conjunction with the accompanying drawings, provides a fuller understanding of the nature and advantages of the present invention.

DETAILED DESCRIPTION

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

Further, as used herein, the term "about" when combined with a value refers to plus and minus 10% of the reference value. For example, a length of about 10 inches refers to a length of 10 inches±1 inch.

As discussed previously, conventional undergarments include three openings, i.e., two smaller openings configured to fit the legs of a human wearer, and one larger opening configured to fit the torso of a human wearer. The configuration of conventional undergarments thus requires a specific orientation to properly don said undergarments. For example, prior to donning a convention undergarment, a human wearer needs to ensure that the two smaller openings are positioned so as to receive his/her legs and the larger opening is positioned so as to receive his/her torso. The attention and/or coordination needed to orient and don a conventional undergarment may be difficult for children, the elderly, people with disabilities, people needing to dress quickly and/or in limited or no light, etc. Additional disadvantages associated with convention undergarments may include uneven wear, unnecessary and/or complicated flaps, inefficient and costly manufacturing processes, etc.

Embodiments disclosed herein overcome the aforementioned disadvantages by providing a novel undergarment having three openings with equal dimensions. The novel undergarments described herein may also include equally sized fabric panels suspended between the openings in some approaches. The novel undergarments disclosed herein may facilitate a human wearer's ability to dress herself/himself where said human wearer lacks the capacity to do so with conventional undergarments requiring a specific orientation to properly don. In particular, the novel undergarments disclosed herein may allow for simplified use by a human wearer as they reduce the number of steps when donning (e.g., no need to orient the undergarment) and thus reduce the annoyance and time required for dressing.

The novel undergarments disclosed herein may have many uses. For example, such undergarments may be used as underwear worn in contact with the skin of the human wearer, as a swimsuit, as a cover for a disposable garment (e.g., a diaper) intended for single or temporary use, etc. Such undergarments may further be useful for military personnel or emergency service providers who may often dress under duress, quickly, in limited or no light, etc. Furthermore, such undergarments may also be configured as disposable medical undergarments or for use in other institutional settings.

Referring now to FIG. 1A, an undergarment 100 is shown according to one embodiment. The undergarment 100 may include and/or be used in conjunction with features from any other embodiment listed herein, such as those described with reference to the other FIGS. However, the undergarment 100 may be used in various applications and/or in permutations which may or may not be specifically described in the illustrative embodiments listed herein. Moreover, unless otherwise specified, one or more portions and/or features of the undergarment 100 may be of conventional material(s), design, fabricated using conventional techniques, and/or used in any desired environment as would become apparent to one skilled in the art upon reading the present disclosure.

Figure 1B:
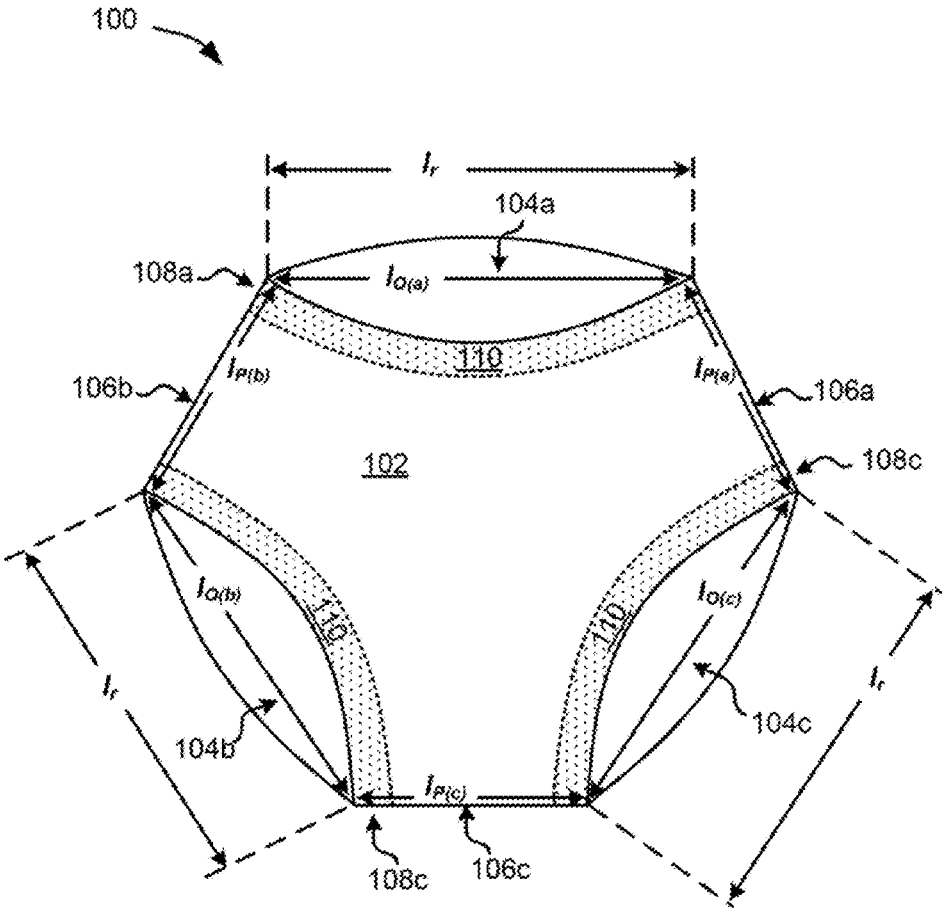

It is important to note that the undergarment 100 does not have a traditional "front" and "back." However, for clarity, FIG. 1A depicts a view of "Side A" of the undergarment 100, whereas FIG. 1B depicts a view of the opposite "Side B." In preferred approaches, Side A and Side B of the undergarment 100 may be substantially the same as one another (e.g., have substantially the same dimensions, include substantially the same materials, etc.). Accordingly, in various approaches, the undergarment 100 may be worn such that either Side A or Side B cover a portion of the buttocks of a human wearer. In additional approaches, the undergarment may also be reversible (e.g., where the interior and exterior of the undergarment are interchangeable).

As shown in FIGS. 1A-1B, the undergarment 100 comprises a main body 102 that includes at least one stretchable material. As used herein, a stretchable material may refer to a material configured to stretch/lengthen/extend in at least one dimension under tension, and return/retract to about its original size when the tension is removed. In various approaches, the at least one stretchable material may include any woven, nonwoven or knitted material. In preferred approaches, the stretchable material may be multi-stretch (e.g., a 4-way stretch) material configured to stretch at least lengthwise and crosswise. In more approaches, the stretchable material may be stretched over 500% of its original size without breaking.

In particular approaches, the stretchable material may include one or more elastomeric fibers. Elastomeric fibers are fibers that exhibit a high degree of elasticity. For instance, elastomeric fibers exhibit high elongations (able to stretch 400% or more) at break and recover rapidly from said high elongations. Elastomeric fibers may include, but are not limited to, spandex (a manufactured fiber in which the fiber forming substance is a long chain synthetic polymer comprised of at least 85% of a segmented polyurethane), lastol, rubber (natural or synthetic), biconstituent fibers of nylon and spandex, etc. In approaches where the stretchable material may include one or more elastomeric fibers, the elastomeric fibers may be present in a range from about 10% by weight of the fabric to about 100% by weight of the fabric. In some approaches, the stretchable material may include only elastomeric fibers (i.e., 100% wt. % of elastomeric fibers). In more approaches, the at least one stretchable material may also include one or more natural fibers (e.g., cotton, wool, silk, cellulose fibers, etc.) and/or one or more synthetic fibers (e.g., polyester, nylon, acrylic, polyolefin, rayon, etc.).

In yet more approaches, the stretchable material may include a disposable and environmentally friendly (e.g., biodegradable) material. In further approaches, the stretchable material may include one or more plastic and/or other polymeric materials.

In additional approaches, the main body 102 may include one or more optional additives, including but not limited to colorants, pigments, crosslinking agents, phase change materials, antimicrobial materials, chlorine degradation resistant materials, fragrances, insect repellants, materials configured to provide UV protection (e.g., materials having a Sun Protection Factor (SPF) of about 5 or greater), anti-static agents, wetting agents, etc.

As also shown in FIGS. 1A-1B, the undergarment 100 includes three openings 104*a*, 104*b*, 104*c*, where each opening is configured to encircle/encase a portion of the torso and/or a leg of a human wearer. In various approaches, each of the openings 104*a*, 104*b*, 104*c* may have a circular, elliptical or generally rounded shape.

In some approaches, the dimensions of the main body 102 and the openings 104*a*, 104*b*, 104*c* may be selected such that the undergarment 100 is configured to fit a child (i.e., a female or male human ranging from infancy to under the age of majority). In other approaches, the dimensions of the main body 102 and the openings 104*a*, 104*b*, 104*c* may be selected such that the undergarment 100 may be configured to fit an adult (i.e., a female or male human at the age of majority or older).

In preferred approaches, each of the openings 104*a*, 104*b*, 104*c* may have equal dimensions. For instance, the opening 104*a* may have a length $l_{O(a)}$ corresponding to the distance between peripheral edges 106*a* and 106*b* of the main body 102; the opening 104*b* may have a length $l_{O(b)}$ corresponding to the distance between peripheral edges 106*b* and 106*c*; and the opening 104*c* may have a length $l_{O(c)}$ corresponding to the distance between peripheral edges 106*a* and 106*c*. In preferred approaches, the lengths $l_{O(a)}$, $l_{O(b)}$, and $l_{O(c)}$ may be substantially the same as one another (e.g., $l_{O(a)}=l_{O(b)}=l_{O(c)}$). In particular approaches, each of these lengths $l_{O(a)}$, $l_{O(b)}$, $l_{O(c)}$ may be in a range from about 1.5 inches to about 60 inches. In yet more preferred approaches, each of the openings 104*a*, 104*b*, 104*c* may also have the same circumference as one another.

In further approaches, the lengths and/or circumferences of each opening may be tailored to suit the proportions of a particular human wearer (e.g. a child, a male human, or a female human), as noted above.

As discussed previously, a configuration where each of the openings 104*a*, 104*b*, 104*c* have equal dimensions as one another (e.g., are of the same size and define the same size aperture) allows for simplified use because a human wearer need not determine a "front" or "back" of the undergarment 100 or determine which opening is designed to accept the waist or leg.

Figure 1C:
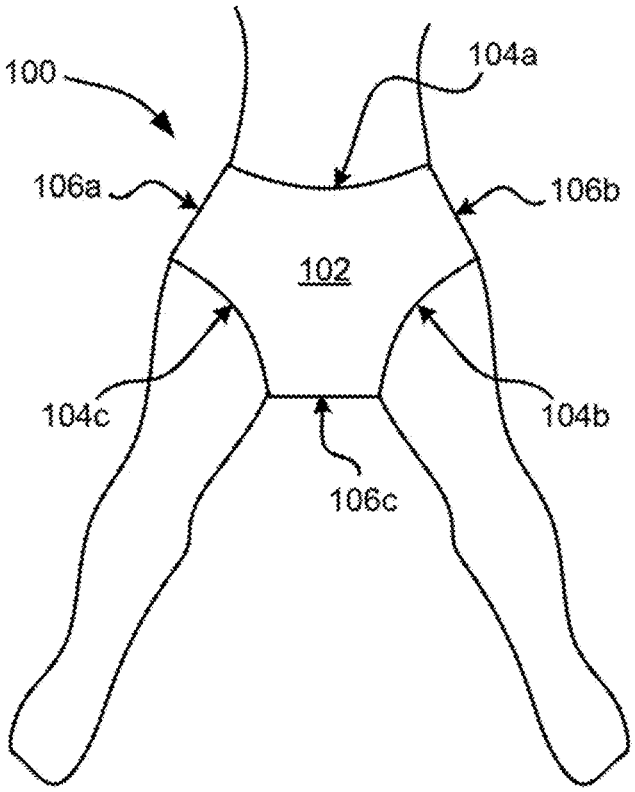
FIGS. 1C-1E illustrate various orientations of the undergarment 100 on a human wearer.
Figure 1D:
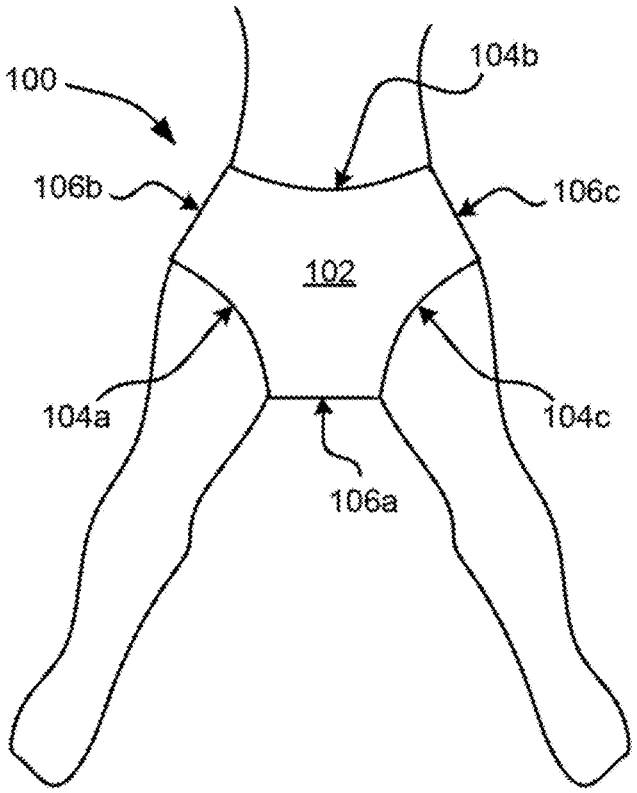
Figure 1E:
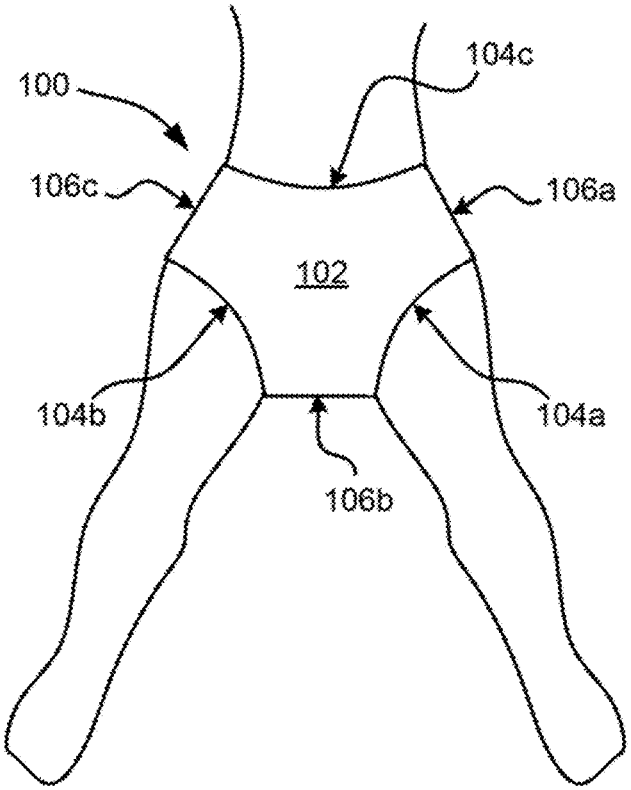

FIGS. 1C-1E illustrate the benefits of a configuration in which each of the openings 104*a*, 104*b*, 104*c* of the undergarment 100 have equal dimensions. For example, as shown in FIG. 1C, the undergarment 100 is worn such that the opening 104*a* conforms to a portion of the torso of human wearer, whereas the openings 104*b*, 104*c* conform to a portion of the legs of the human wearer. However, as shown in FIG. 1D, the undergarment 100 is worn such that the opening 104*b* conforms to a portion of the torso of human wearer, whereas the openings 104*a*, 104*c* conform to a portion of the legs of the human wearer. Finally, as shown in FIG. 1E, the undergarment is worn such that the opening 104*c* conforms to a portion of the torso of human wearer, whereas the openings 104*a*, 104*b* conform to a portion of the legs of the human wearer. FIGS. 1C-1E illustrate a view of only one side of the undergarment 100, however it is again of note that the each side (e.g., Side A and Side B) of the undergarment may be interchangeable.

As discussed previously, the undergarment includes three peripheral edges 106*a*, 106*b*, and 106*c*, where adjacent openings have one peripheral edge located therebetween. As shown in FIGS. 1A-1B, the lengths $l_{P(a)}$, $l_{P(b)}$, $l_{P(c)}$, of the peripheral edges 106*a*, 106*b*, and 106*c*, respectively, are substantially the same as one another (e.g., $l_{P(a)}=l_{P(b)}=l_{P(c)}$) in preferred approaches. In particular approaches, each of these lengths $l_{P(a)}$, $l_{P(b)}$, $l_{P(c)}$ may be in a range from about 1 inch to about 30 inches. In various approaches, the lengths $l_{P(a)}$, $l_{P(b)}$, $l_{P(c)}$ may be tailored for the proportions of a particular human wearer (e.g. a child, a male human, or a female human). For example, in approaches where the undergarment 100 may be worn by a female human wearer, each of the peripheral edges 106*a*, 106*b*, and 106*c* may have smaller lengths $l_{P(a)}$, $l_{P(b)}$, $l_{P(c)}$, respectively, as compared to approaches where the undergarment 100 may be worn by a male human wearer.

The undergarment 100 described in any of the embodiments herein may optionally include an identification label located at or near one or more of the peripheral edges 106*a*, 106*b*, and 106*c*. The identification label(s) may include any type of identifying feature including, but not limited to, one or more letters, one or more numbers, a particular color or a particular combination of colors, a particular print/design, a particular type of material, and combinations thereof. Affixing the identification label to the main body 102 of the undergarment may include a painting process, an embroidery process, a sewing process, a printing process, a gluing process, or other such suitable process as would be recognized by one having skill in the art upon reading the present disclosure. In some approaches, the identification label may be an integral part of a portion of the main body 102 near a peripheral edge, e.g., the identification label may be sewn into the main body 102 such that the exterior, upper surface of the identification label does not protrude above the exterior, upper surface of said portion of the main body 102. In other approaches, the identification label may include a separate piece of fabric that is sewn onto a portion of the main body 102 near a peripheral edge such that the identification label protrudes above the exterior, upper surface of said portion of the main body 102.

Figure 2A:
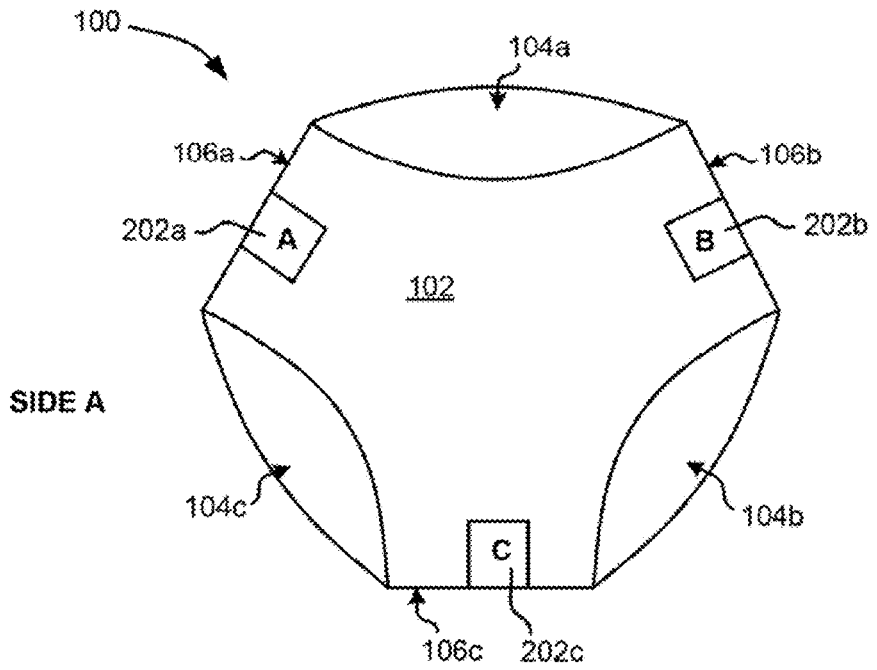
FIGS. 2A-2H are schematic representations of the undergarment 100 according to various embodiments in which said undergarment may include one or more identification labels.
Figure 2B:
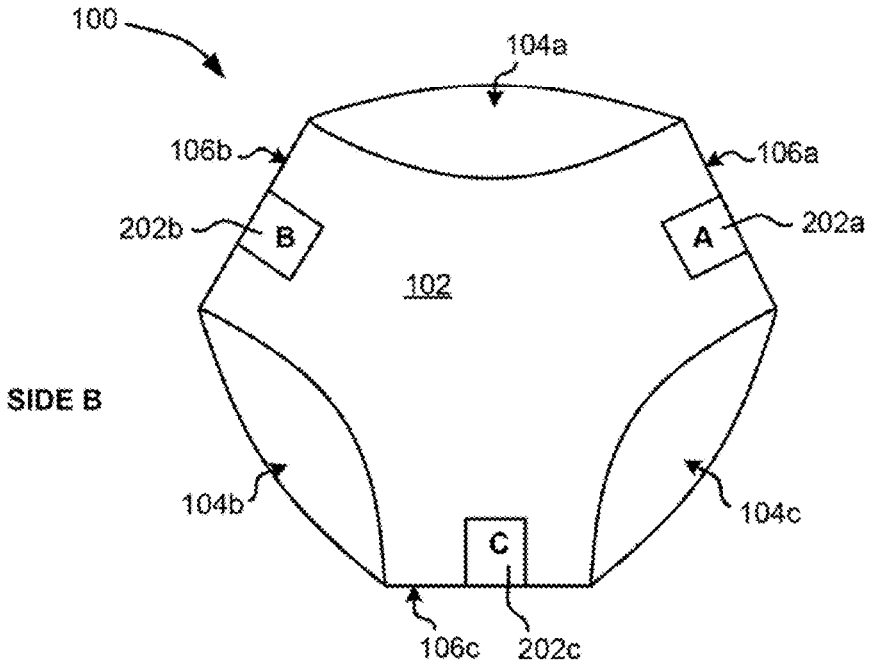
Figure 2C:
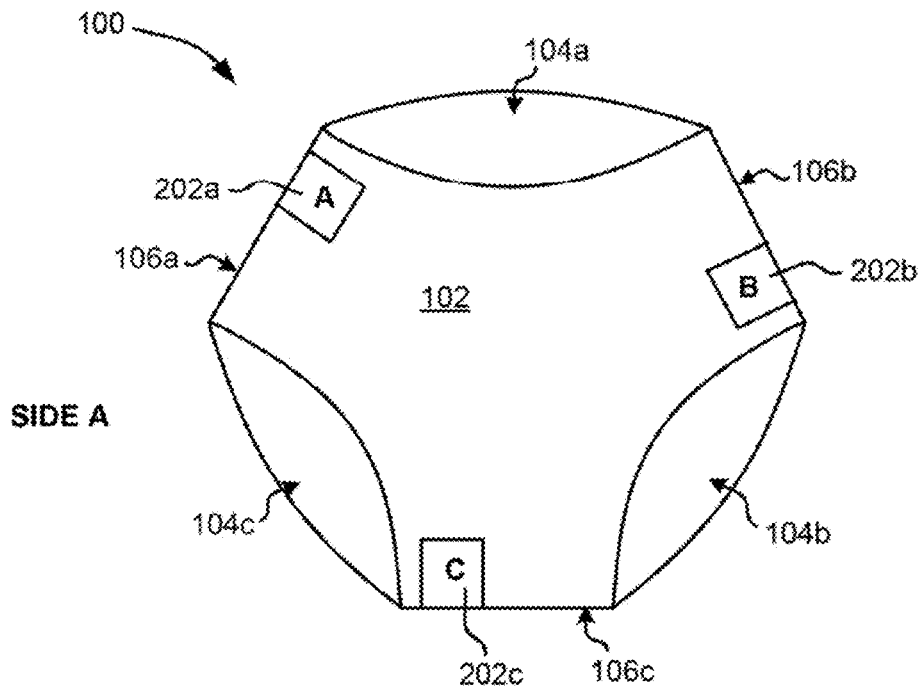
Figure 2D:
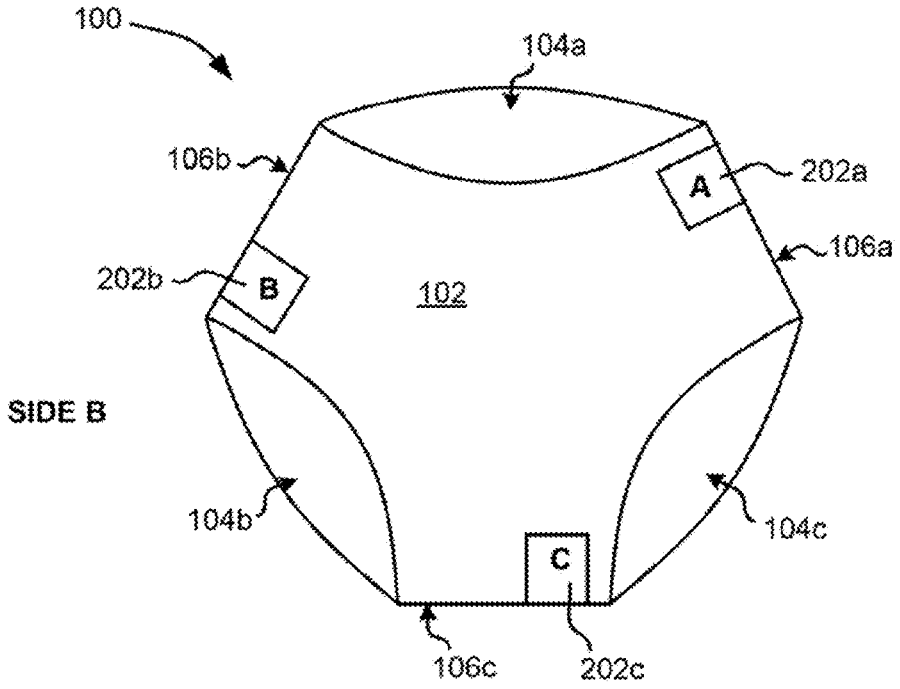
Figure 2E:
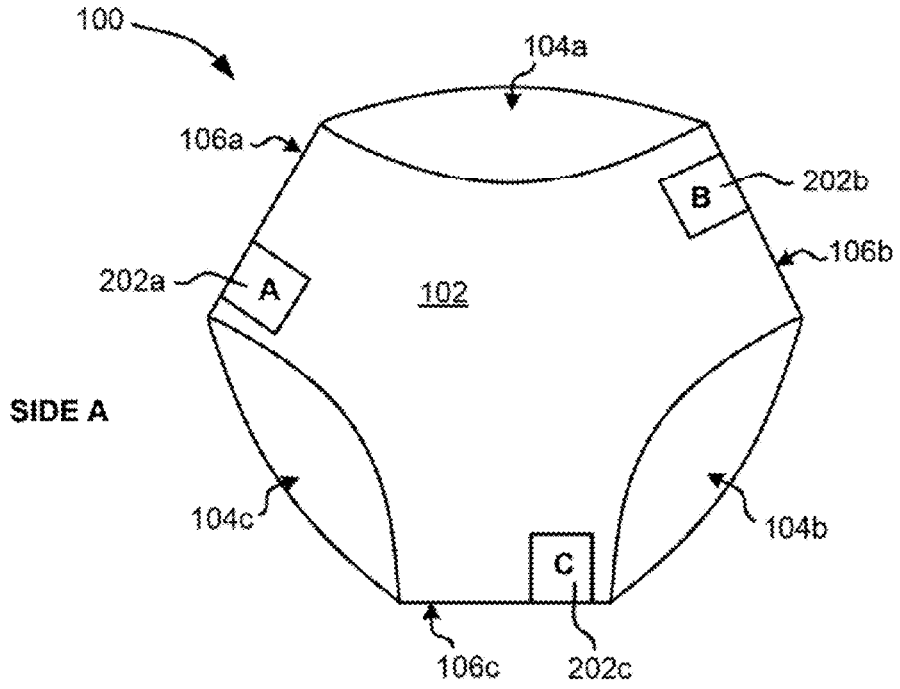
Figure 2F:
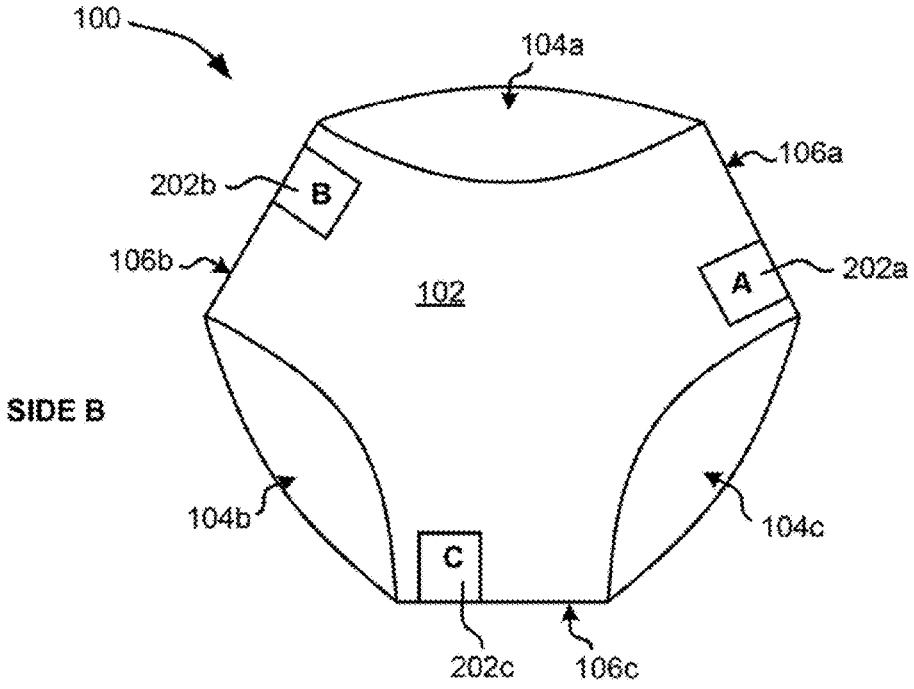

FIGS. 2A-2B depict views of Side A and Side B of the undergarment 100, and illustrate an embodiment in which identification labels 202*a*, 202*b*, 202*c* may span the peripheral edges 106*a*, 106*b*, and 106*c*, respectively. As these identification labels 202*a*, 202*b*, 202*c* may span their respective peripheral edges 106*a*, 106*b*, and 106*c*, said identification labels are present on both Side A and Side B of the undergarment 100.

In the non-limiting embodiment of FIGS. 2A-2B, the identification labels 202*a*, 202*b*, 202*c* may include the letters "A," "B," and "C," respectively. These identification labels may be helpful in approaches where the undergarment 100 may be selected for multiple use by a human wearer. For instance, a human wearer may first wear the undergarment 100 in a configuration where the peripheral edge 106*c* and the identification label 202*c* associated therewith are positioned in his/her crotch area. For a subsequent use of the undergarment 100, the human wearer may wish to rotate said undergarment 100 such that a different peripheral edge will be located in his/her crotch area. Accordingly, the human wearer may look for the "C" identification label 202*c* when donning the undergarment 100 for the subsequent use to ensure that the "C" identification label is not positioned in his/her crotch area.

While the identification labels 202*a*, 202*b*, 202*c* in FIGS. 2A-2B may be located near the middle of the peripheral edges 106*a*, 106*b*, and 106*c*, respectively, and span said peripheral edges, this need not be the case. For instance, in other optional embodiments, the identification labels 202*a*, 202*b*, 202*c* may be positioned closer toward an opening to which they are adjacent as shown in FIGS. 2C-2F. Consider identification label 202*a* as a representative example. In one embodiment, identification label 202*a* may be positioned closer to opening 104*a*, as shown in the Side A and Side B views of FIGS. 2C-2D, respectively. However, in another embodiment, identification label 202*a* may be closer to opening 104*c*, as shown in the Side A and Side B views of FIGS. 2E-2F, respectively.

Figure 2G:
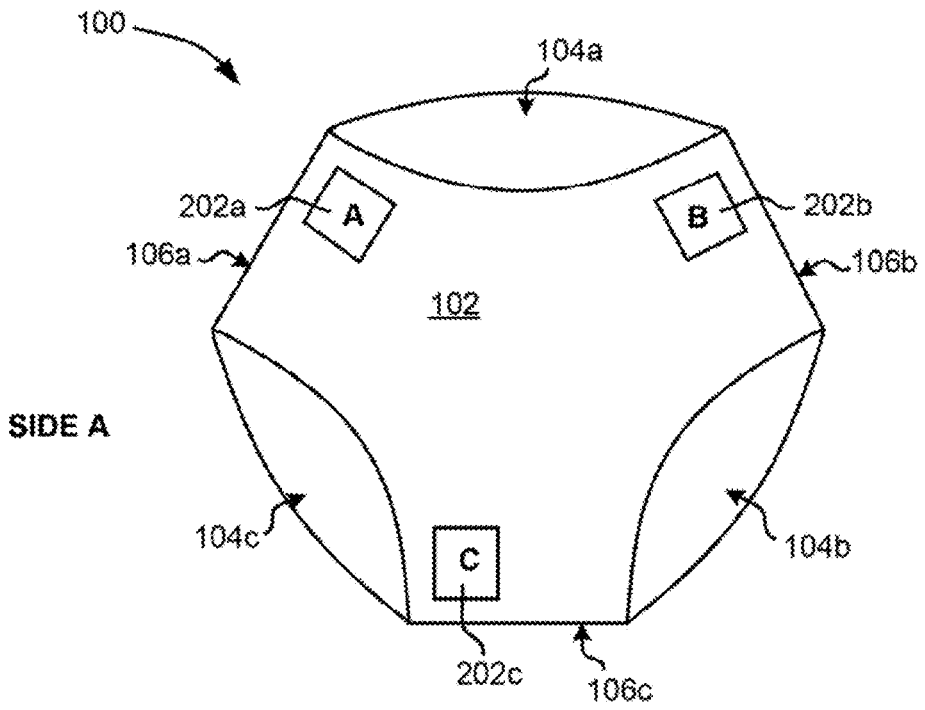
Figure 2H:
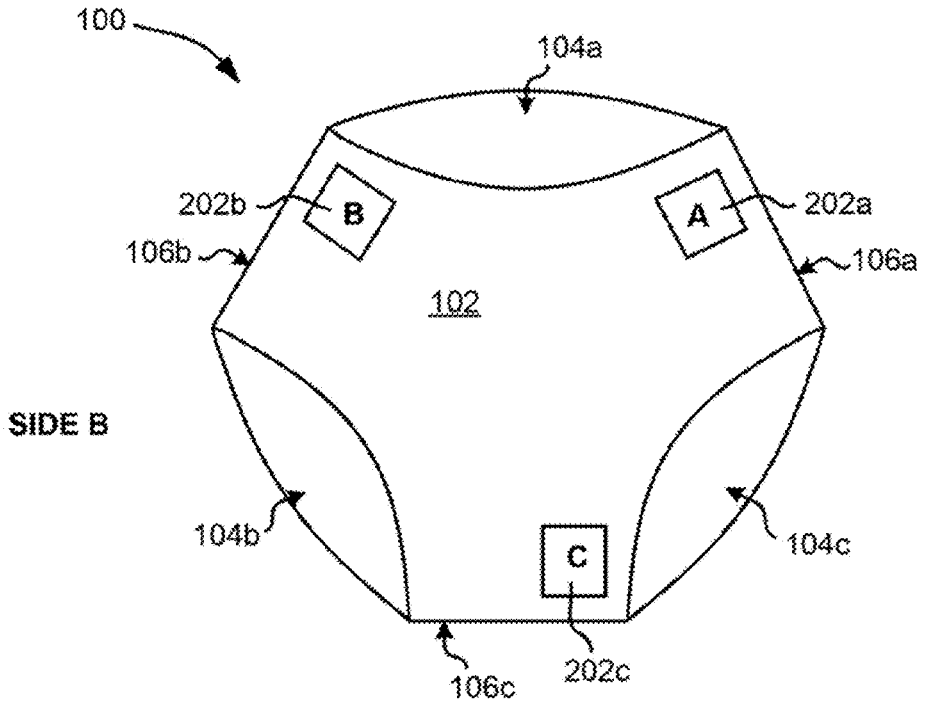

In yet another embodiment, the identification labels 202*a*, 202*b*, 202*c* may not span their respective peripheral edges 106*a*, 106*b*, and 106*c*, but rather may be located near said edges on one or both sides of the undergarment 100. For instance, the identification labels 202*a*, 202*b*, 202*c* may be located near each of their respective peripheral edges 106*a*, 106*b*, and 106*c* on Side A of the undergarment 100 as shown in FIG. 2G, and/or on Side B of the undergarment 100 as shown in FIG. 2H.

It is important to note that the aforementioned identifications labels may be designed and/or configured in any manner that may facilitate identification of a particular opening and/or peripheral edge of the undergarment 100.

Moreover, the undergarment may include any number of identification labels (e.g., 0, 1, 2, 3, 4, 5, 6, etc.).

Figure 3A:
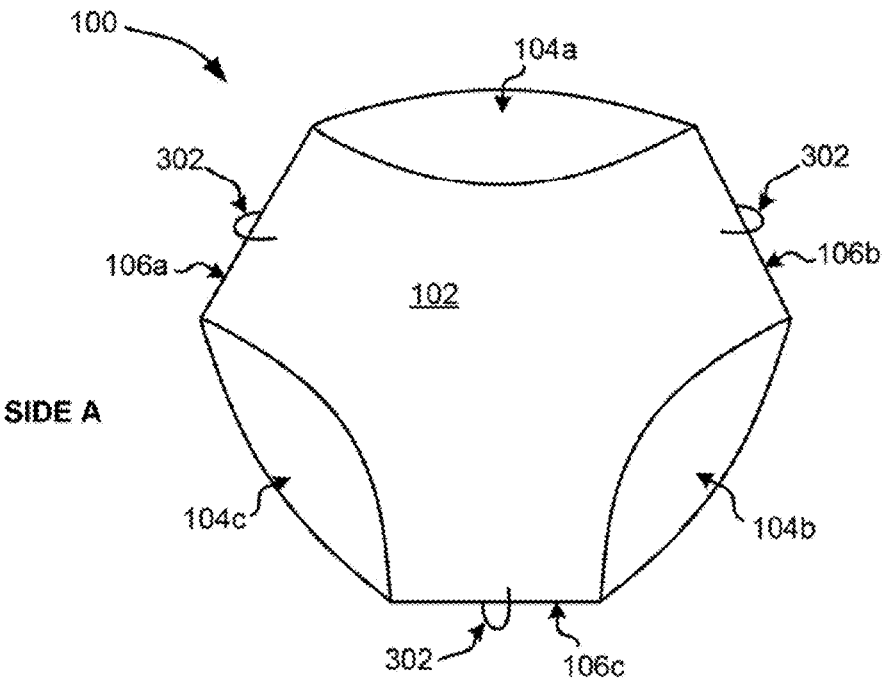
FIGS. 3A-3C are schematic representations of the undergarment 100 according to various embodiments in which said undergarment may include one or more loops 302 attached to the exterior surface thereof.
Figure 3B:
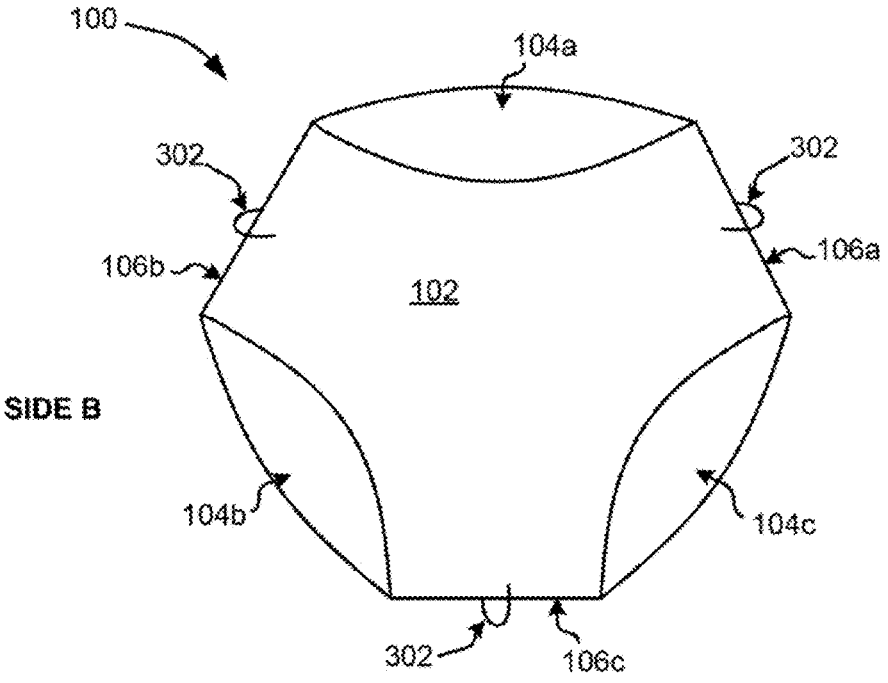
Figure 3C:
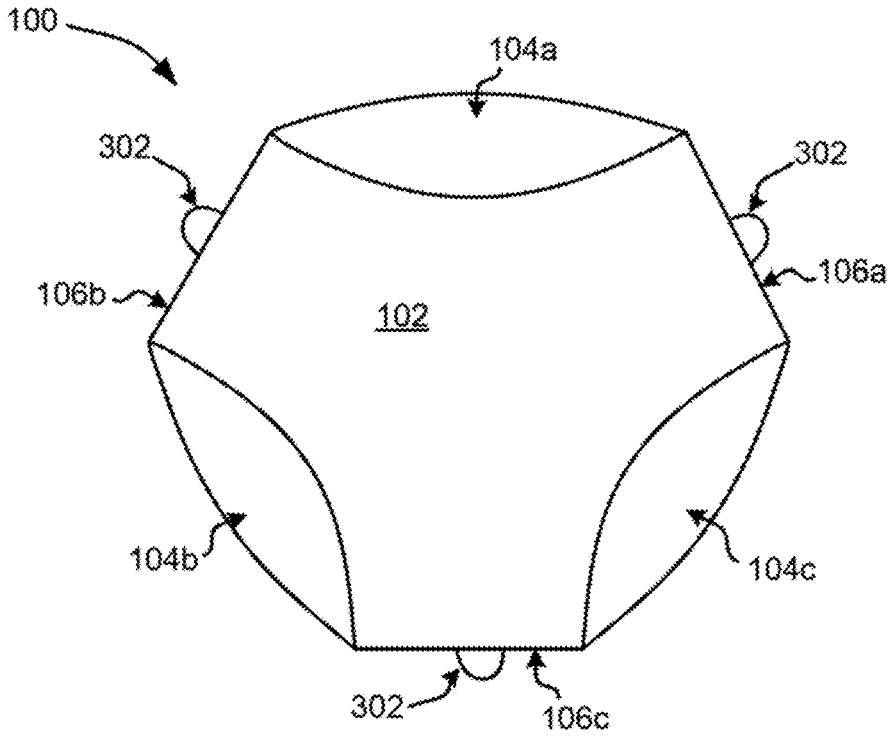

FIGS. 3A-3B depict views of Side A and Side B of the undergarment 100, and illustrate an embodiment in which said undergarment may include one or more optional loops 302 attached to one or more portions of the exterior surface thereof. In the particular embodiment shown in FIGS. 3A-3B, one such loop 302 may span each of the peripheral edges 106*a*, 106*b*, and 106*c* of the undergarment 100. These loops 302 may be configured to allow a human wearer to hook one or more fingers through the loop, or otherwise grab the loop, thus facilitating the process of putting on the undergarment 100. The location and/or orientation of the loops 302 are not limited to the particular configuration shown in FIGS. 3A-3B. For instance, in alternative approaches, the loops 302 may be rotated about 90 degrees, as shown in FIG. 3C.

In yet other approaches, each loop 302 may be positioned anywhere near or along its respective peripheral edge. For example, in one approach, each loop 302 may be positioned closer toward an opening to which it is adjacent. In yet other approaches, one end of each of the loops 302 may not be attached to the main body 102, thereby producing strips of material for a human wearer to grab and use when pulling on the undergarment 100.

In additional approaches, the undergarment 100 described in any of the embodiments herein may optionally include an additional stretchable material at and/or near at least one of the openings 104*a*, 104*b*, 104*c*. This additional stretchable material may be configured to define and/or provide additional elasticity to the opening. In one exemplary approach, the additional stretchable material may include an elastic band. For instance, in the non-limiting embodiment shown in FIGS. 1A-1B, the portions 108*a*, 108*b*, 108*c* of the main body 102 that terminate at each of the openings 104*a*, 104*b*, 104*c*, respectively, may comprise this additional stretchable material 110.

This additional stretchable material 110 may preferably exhibit a greater degree of stretch/elasticity than the stretchable material comprising the main body 102. In yet more preferred approaches, this additional stretchable material 110 may have a retracted length that is less than the retracted length of the adjacent portion of the main body 102. For example, the retracted length, $l_r$, of the additional material 110 may correspond to its length in the absence of the force required to stretch the additional material 110 (e.g., the length prior to the implementation, or after the removal, of said force). Accordingly, in various approaches the additional stretchable material 110 may retract to a shorter length than the portion (e.g., 108*a*, 108*b*, 108*c*) of the main body 102 to which it is connected/attached when the force needed to stretch the additional stretchable material 110 and said portion (e.g., 108*a*, 108*b*, 108*c*) of the main body 102 is absent. In approaches where the undergarment 100 includes the additional stretchable material at one or more of the openings 104*a*, 104*b*, 104*c*, the retracted length, $l_r$, of said additional material 110 may define the length of the respective opening.

In yet other approaches, the main body 102 may include a cinching device positioned at or near at least one of the openings 104*a*, 104*b*, 104*c* that is configured to alter the size of the opening. Such a cinching device may allow a human wearer to alter (e.g., reduce) the size of the opening to which the device is connected/coupled in order to achieve a desired fit. Examples of a cinching device may include, but are not limited to, a draw string, one or more buttons, Velcro®, a hook and loop fastener, etc.

Figure 4A:
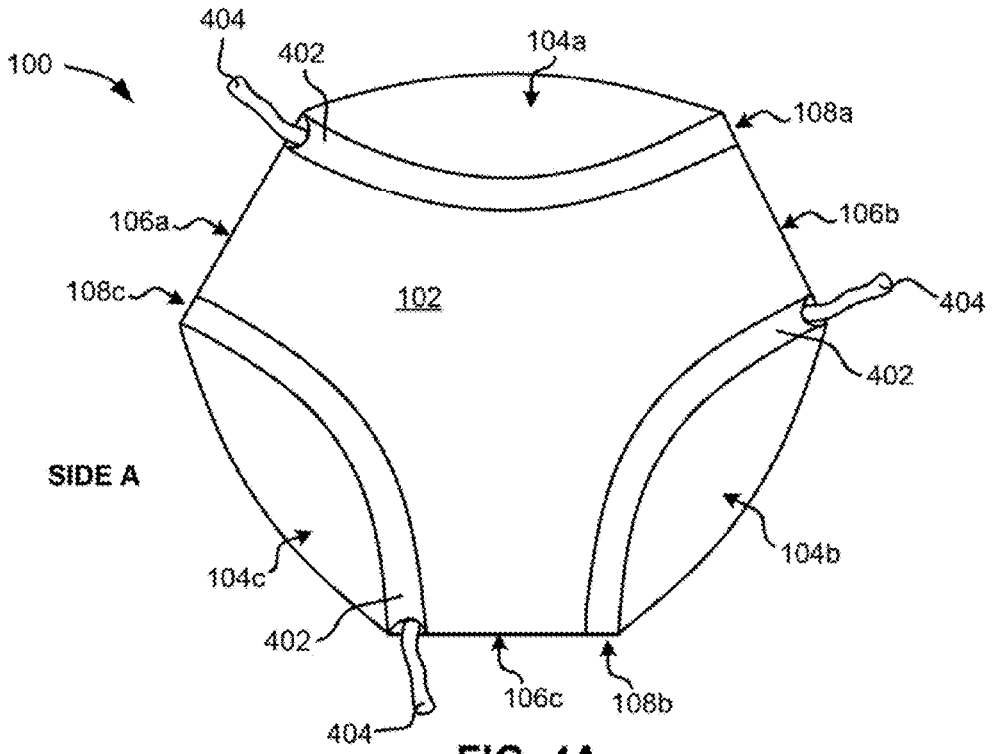
FIGS. 4A-4G are schematic representations of the undergarment 100 according to various embodiments in which said undergarment may include a draw string located at each of the openings thereof, where the draw strings are configured to alter the size of their respective openings.
Figure 4B:
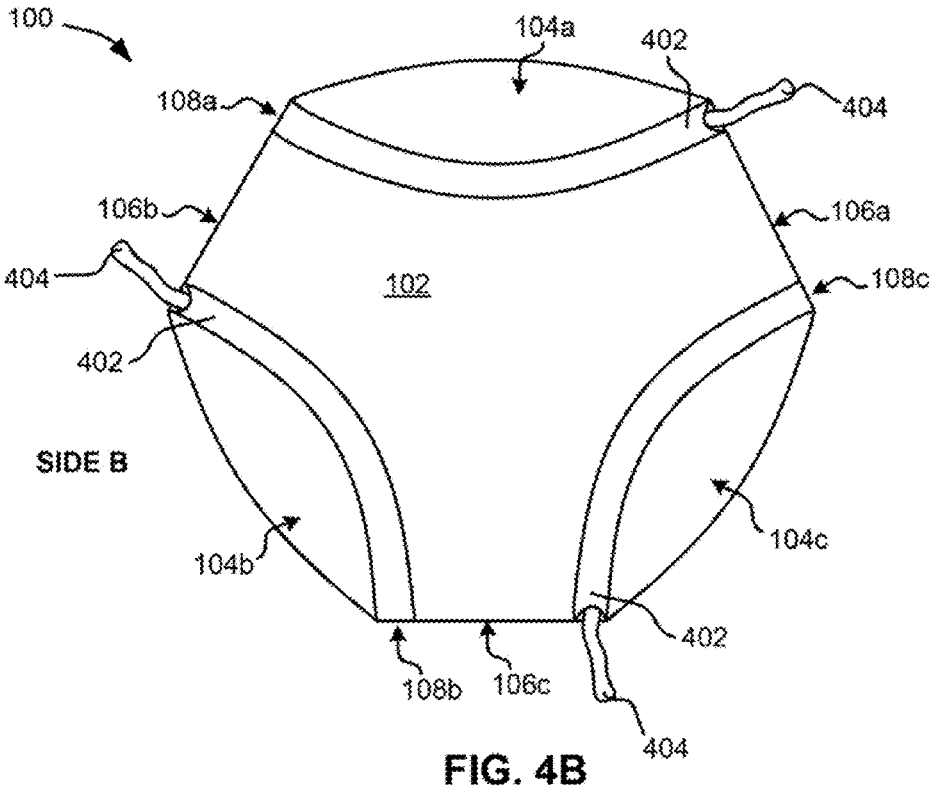
Figure 4E:
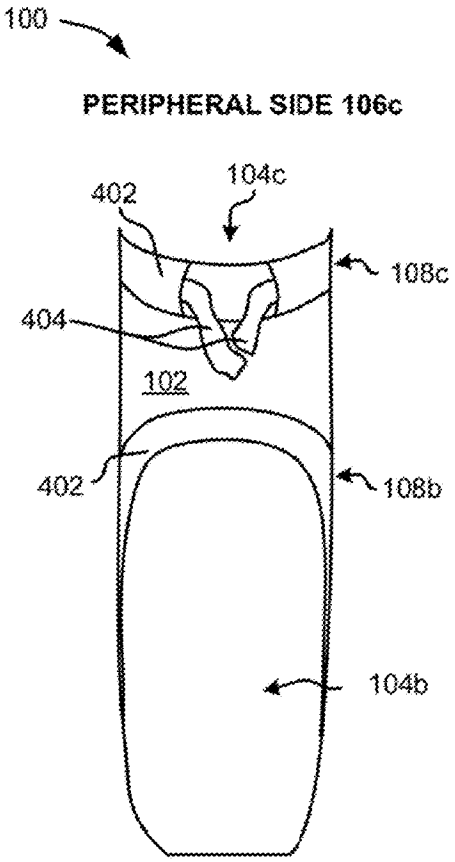
Figure 4D:
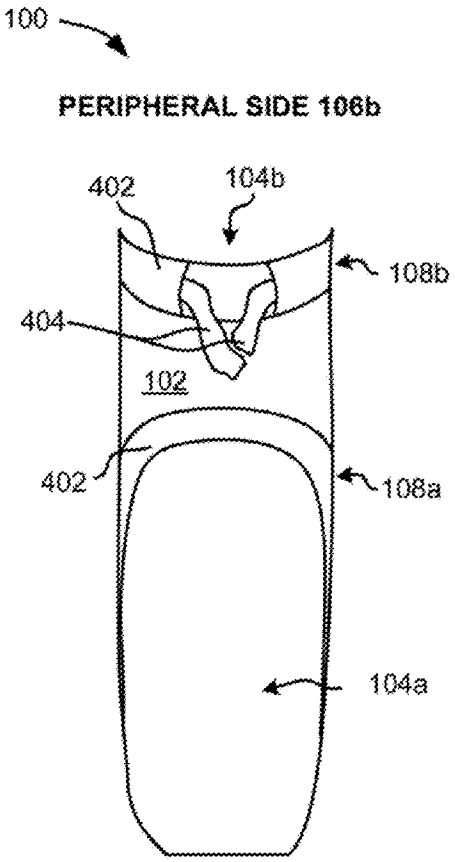
Figure 4C:
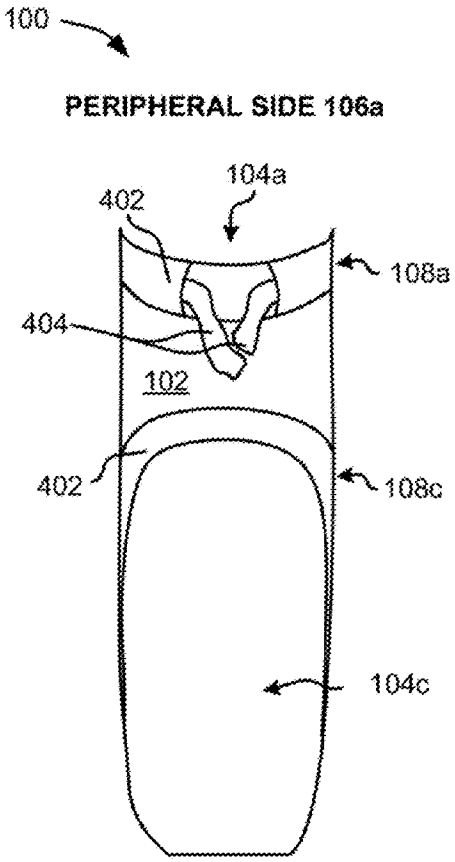

FIGS. 4A-4B provide views of Side A and Side B of the undergarment 100, and illustrate an embodiment in which the portions 108*a*, 108*b*, 108*c* of the main body 102 may include a single loop 402 through which a draw string 404 is fed. FIGS. 4C-4E provide views of the peripheral edges 106*a*, 106*b*, 106*c*, respectively. The draw strings 404 may enable a human wearer to alter the size of the openings 104*a*, 104*b*, 104*c*. For instance, by tying the draw strings 404 in a bow, knot, etc., the size of each opening 104*a*, 104*b*, 104*c* may be adjusted to as to achieve a desired fit around a portion of the torso and legs of the human wearer.

Figure 4F:
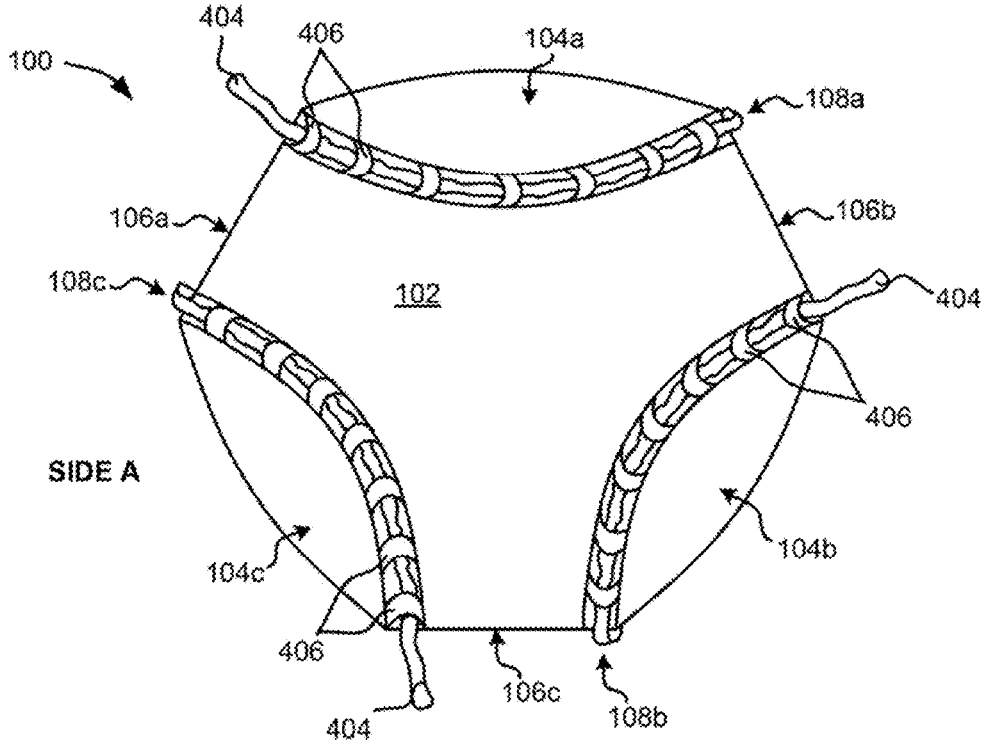
Figure 4G:
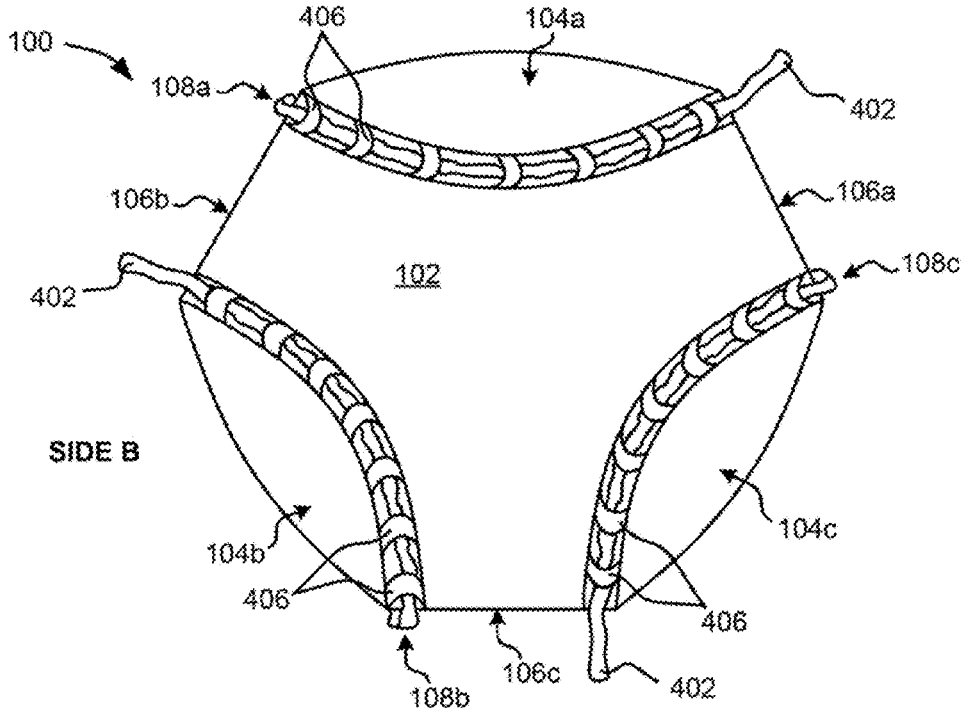

FIGS. 4F-4G provide views of Side A and Side B of the undergarment 100, and illustrate an embodiment in which the aforementioned draw string 404 may be fed through a plurality of loops 406 that are connected/attached to the portions 108*a*, 108*b*, 108*c* of the main body 102 located near each of the openings 104*a*, 104*b*, 104*c*, respectively.

FIGS. SA-5B provides a view of one side of the undergarment 100, and illustrate an embodiment in which one or more buttons 502 are included to alter the size of each of the openings 104*a*, 104*b*, 104*c*. As shown in FIG. SA, a single button 502 and a plurality of eyelets 504 may be located at or near the peripheral edges 106*a*, 106*b*, 106*c* of the main body 102, and at or near each opening 104*a*, 104*b*, 104*c*. A human wearer may choose to feed the button 502 through a particular eyelet 504 so as to reduce the size of an opening 104*a*, 104*b*, 104*c* a desired amount.

Figure 5A:
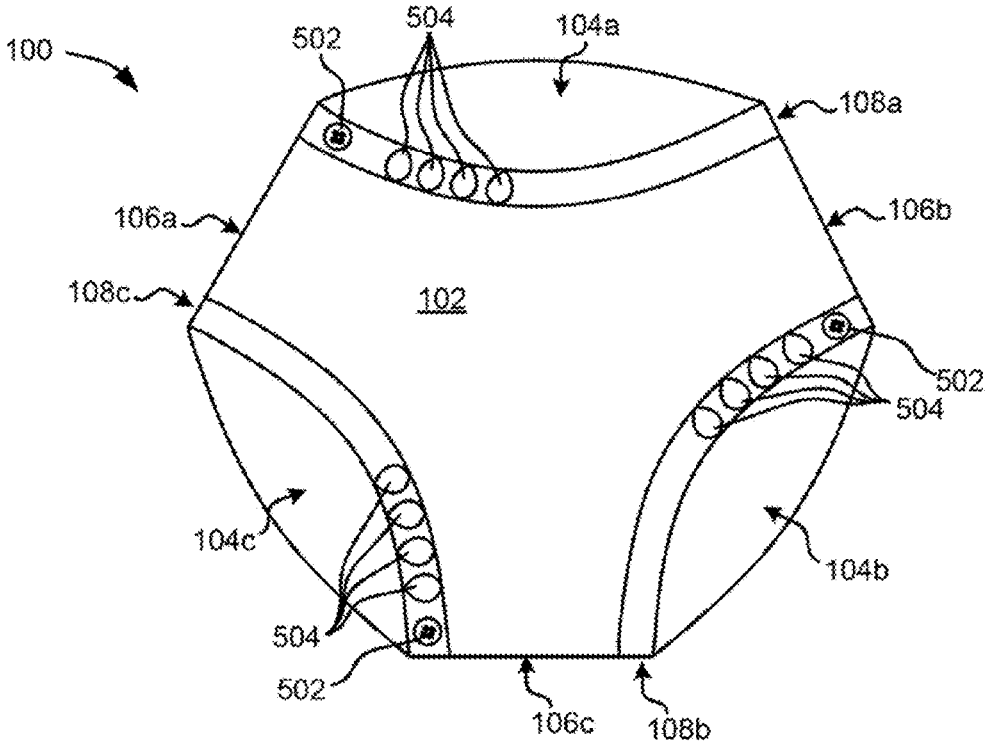
FIGS. 5A-5C are schematic representations of the undergarment 100 according to various embodiments in which said undergarment may include one or more buttons at each of the openings thereof, where each of the buttons are configured to alter the size of their respective opening.

The location of the buttons 502 and the eyelets 504 are not limited by the configuration shown in FIG. 5A; rather, the buttons 502 and the eyelets 504 may be located anywhere along the portions 108*a*, 108*b*, 108*b* of the main body 102. The order of the buttons 502 and the eyelets 504 may also be the reverse of what is shown in FIG. 5A, e.g., the eyelets 504 may be positioned closer to the peripheral edges of the undergarment 100 as compared to the buttons 502. Moreover, the button/eyelet combination may be included on only side of the undergarment 100, or on both sides of the undergarment 100 in some approaches.

Figure 5B:
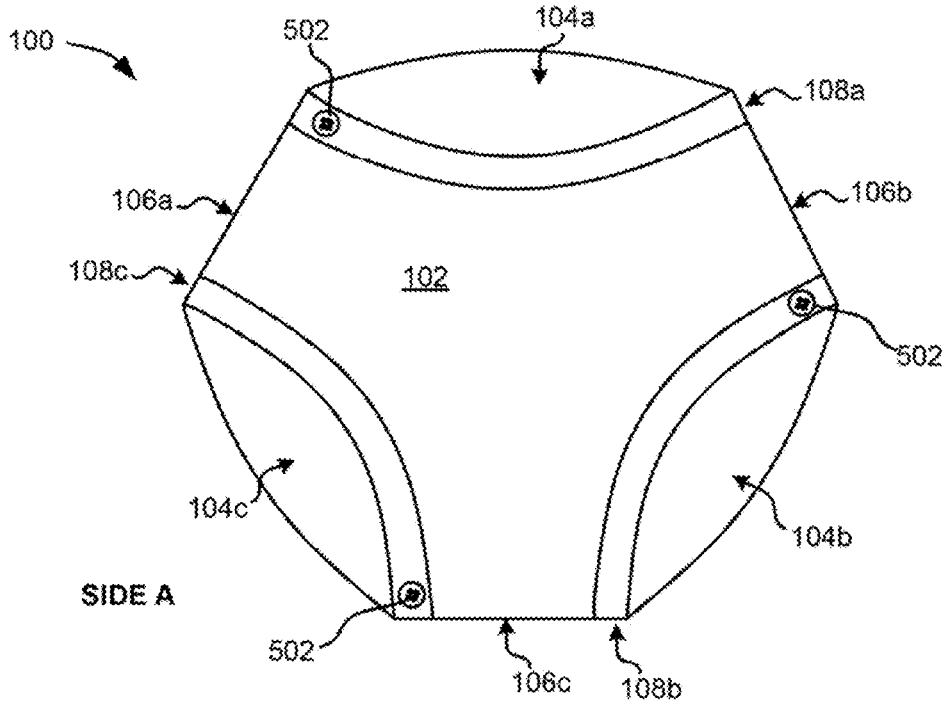
Figure 5C:
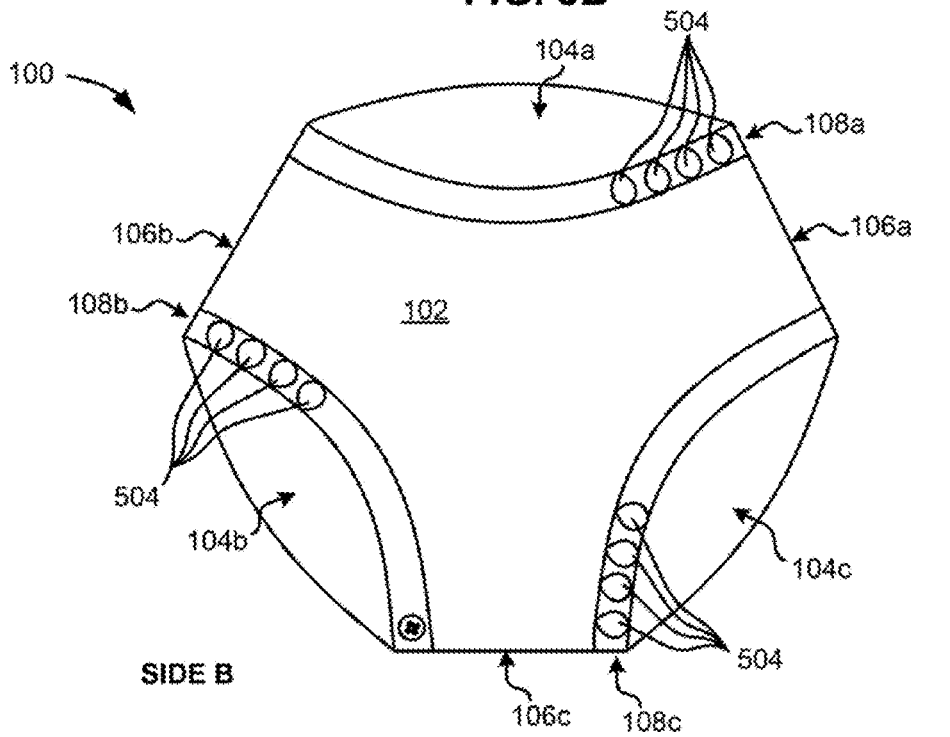

FIG. 5B illustrates another embodiment in which the aforementioned buttons 502 may be located on Side A of the undergarment 100, while the corresponding eyelets 504 may be located on Side B of the undergarment 100.

It is important to note that the undergarment 100 may include any combination of buttons and eyelets (e.g., a single button and a single eyelet; a single button and a plurality of eyelets, a plurality of buttons and a single eyelet, a plurality of buttons and a plurality of eyelets, etc.) as cinching devices at one or more of the openings 104*a*, 104*b*, 104*c* to adjust the size thereof.

Figure 6A:
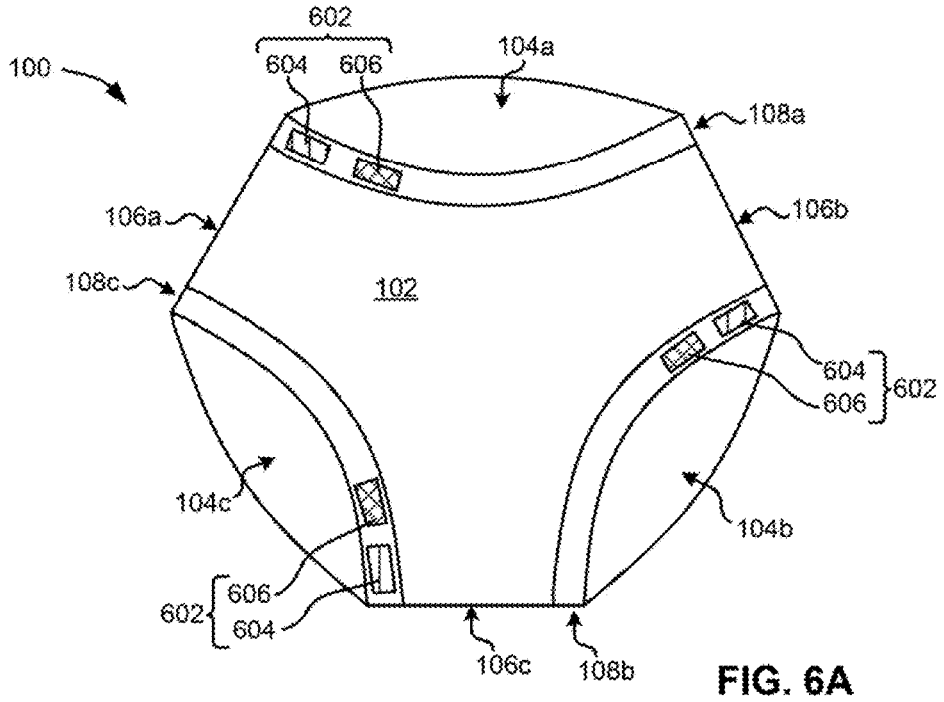
FIGS. 6A-6B are schematic representations of the undergarment 100 according to various embodiments in which said undergarment may include a hook and loop fastener at each of the openings thereof, where each of the hook and loop fasteners are configured to alter the size of their respective opening.
Figure 6B:
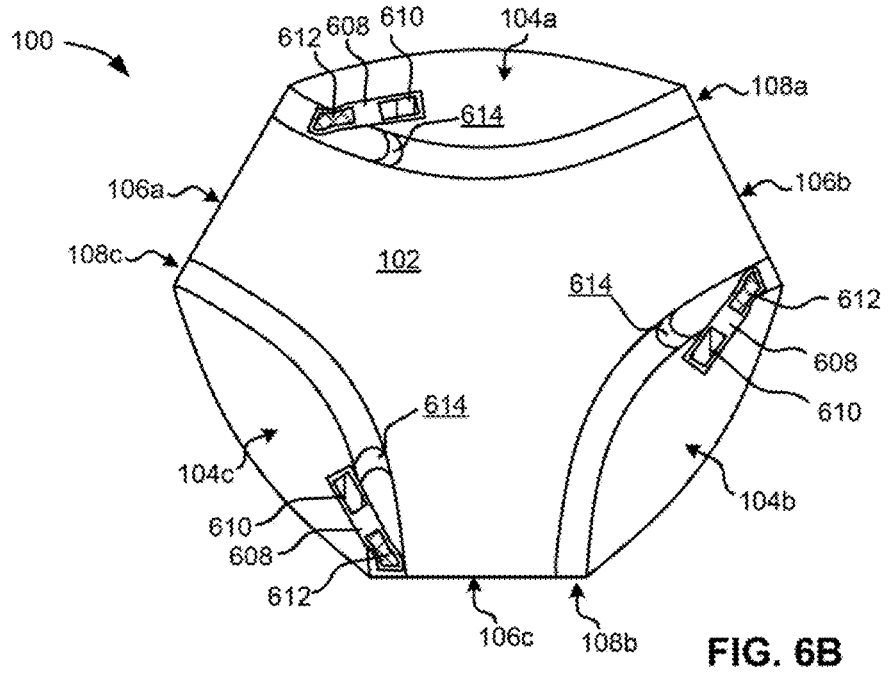

FIGS. 6A-6B provide a view of one side of the undergarment 100, and illustrate various embodiments in which hook and loop fasteners 602 may be included to alter the size of each of the openings 104*a*, 104*b*, 104*c*. As shown in FIG. 6A, each hook and loop fastener 602 may include a first fabric strip 604 comprising the loops and a second fabric strip 606 comprising the hooks that is located a predetermined distance from the first fabric strip 604. The first and second fabric strips 604, 606 may have any shape including, but not limited to, a rectangular shape, a square shape, a circular shape, an elliptical shape, a triangular shape, an irregular shape, etc. When a human wearer puts on the undergarment 100, the human wearer may fold the undergarment 100 such that second fabric strip 606 of at least one of the hook and loop fasteners 602 is above/overlaps a portion of the first fabric strip 604, thereby reducing the size of the respective opening. A human wearer may also choose to fold the undergarment 100 such that the first fabric strip 604 is above/overlaps the second fabric strip 606.

The location of the hook and loop fasteners 602 are not limited by the configuration shown in FIG. 6A, as said fasteners may be located anywhere along the portions 108*a*, 108*b*, 108*b* of the main body 102. The order of the first and second fabric strips 604, 606 in each hook and loop fastener 602 may also be the reverse of what is shown in FIG. 6A, e.g., the second fabric strip 606 of each hook and loop fastener 602 may be positioned closer to the peripheral edges of the undergarment 100 as compared to the first fabric strip 604. Moreover, the hook and loop fasteners 602 may be included on only side of the undergarment 100, or on both sides of the undergarment 100 in some approaches.

FIG. 6B illustrates another embodiment in which each hook and loop fastener 602 may include a single fabric strip 608 with hooks 610 located at one end of the fabric strip and loops 612 located at the opposite end of the single fabric strip 608. Only one end of the single fabric strip 608 (e.g., the end comprising the loops 612) may be attached to the undergarment 100 at one of its ends. A loop/ring 614 may also be located a predetermined distance from the fabric strip 608, where said loop/ring 614 may be comprised of fabric such as those disclosed herein, metal, plastic, combinations thereof, etc. When a human wearer puts on the undergarment 100, the human wearer may thread the portion of the single fabric strip 608 comprising the hooks 610 through the loop/ring 614 and fold the single fabric strip 608 such that the portion with the hooks 610 is above/overlaps the portion with the loops 612, thereby reducing the size of the respective opening.

The location of the single fabric strips 608 and the loops/rings 614 are not limited by the configuration shown in FIG. 6A, as said single fabric strips 608 and loops/rings 614 may be located anywhere along the portions 108*a*, 108*b*, 108*b* of the main body 102. Furthermore, the order of the hooks 610 and loops 612 on each single fabric strip 608 may be reversed, thus the human wearer may thread the portion of the single fabric strip 608 comprising the hooks 610 through the loop/ring 614 and fold the single fabric strip 608 such that the portion with the loops 612 is above/overlaps the portion with the hooks 610. Moreover, the single fabric strip/ring combinations may be included on only one side of the undergarment 100, or on both sides of the undergarment 100 in some approaches. Moreover still, in other approaches, each single fabric strip/ring combination may span its respective peripheral edge such that each single fabric strip 608 may be located on Side A of the undergarment 100 and its corresponding loop/ring 614 may be located on Side B of the undergarment 100.

The undergarment 100 described in any of the embodiments herein may be worn beneath clothes and in direct contact with one or more lower portions of a human wearer. Accordingly, in some approaches an optional liner may be attached to one or more portions of the interior of the undergarment 100. In various approaches, the liner may be configured for the comfort of the human wearer in more approaches. In particular approaches, the liner may be configured to retain, absorb, or prevent bodily fluids from penetrating through the undergarment 100. The liner may also be comprised of an odor absorbent material and/or additionally include a fragrance additive in more approaches. The liner may comprise any suitable material and design as known in the art.

In some approaches, the liner may be temporarily attached to one or more portions of the interior of the undergarment 100. In one approach, the liner may include an adhesive portion to allow temporary attachment of said liner to one or more portions of the interior of the undergarment 100. In another approach, the liner may be temporarily attached to one or more portions of the interior of the undergarment 100 via a fastening device including but not limited to a hook and loop fastener, Velcro®, one or more buttons, etc. In other approaches, the liner may be permanently attached (e.g., sewn into) one or more portions of the interior of the undergarment 100.

Figure 7:
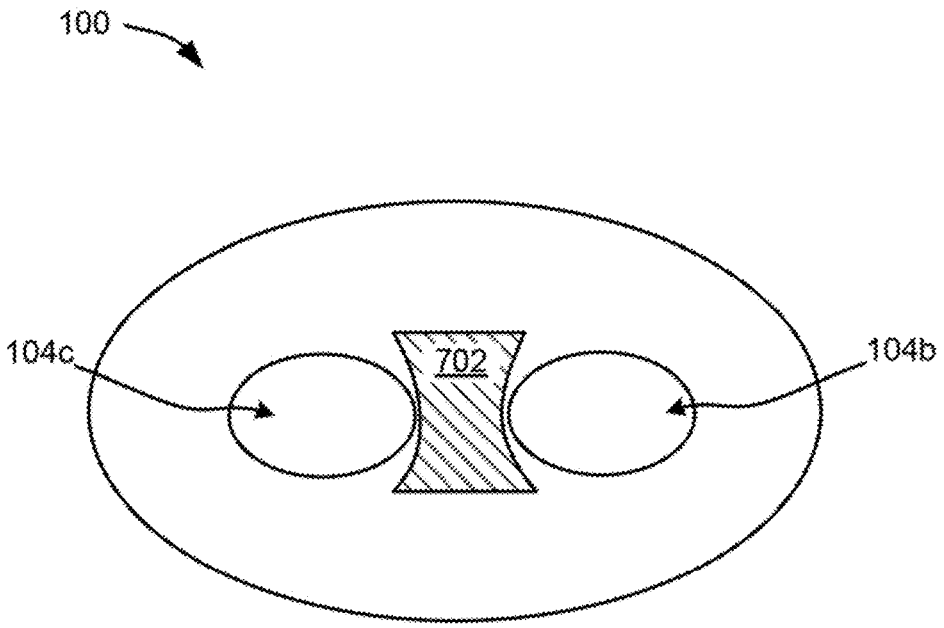
FIG. 7 illustrates an interior view of the undergarment 100 according to one embodiment in which said undergarment may include one or more liners.

In numerous approaches, the liner may be temporarily or permanently attached to an entirety of the undergarment 100. However, in other approaches, one or more liners may be temporarily or permanently attached to predetermined portions of the interior of the undergarment 100. These predetermined portions may include the interior portions of the undergarment 100 located near the peripheral edges thereof. For example, FIG. 7 provides an interior view of the undergarment 100 illustrating a liner 702 attached to the interior portion of the undergarment 100 at the peripheral edge 106*c*. This interior view is taken from the perspective of a human wearer peering inside the undergarment through opening 104*a*. While not shown in the view provided in FIG. 7, a liner 702 may also be attached to the interior portions of the undergarment 100 at the peripheral edges 106*a* and 106*b*.

The undergarment 100 described in any of the embodiments herein may also be worn over a diaper or other such disposable garment intended to be worn by infants, toddlers, adults, etc. for single or temporary use.

Figure 8A:
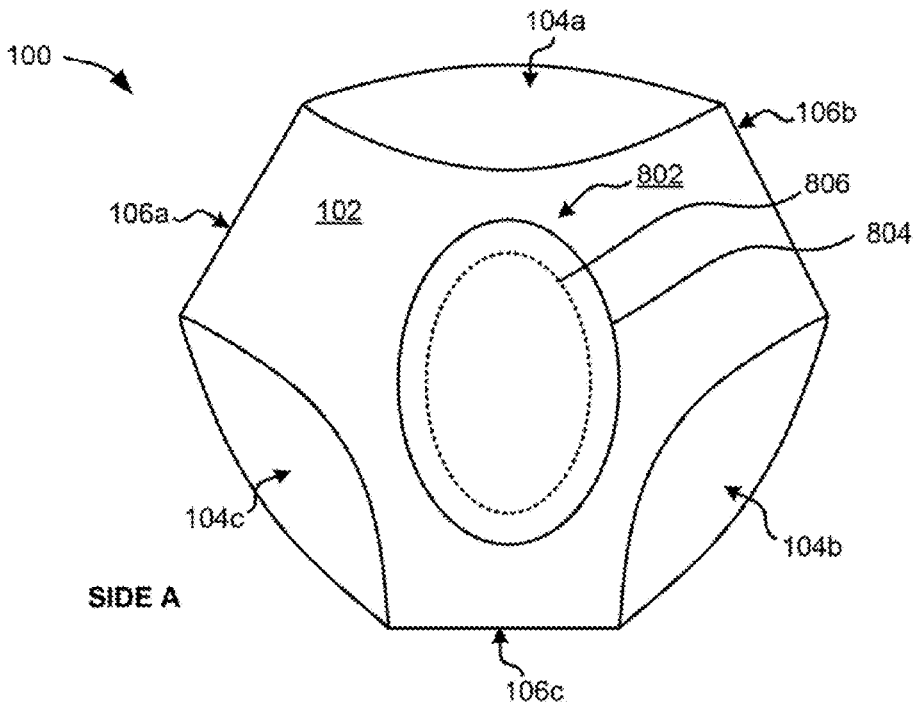
FIGS. 8A-8B are schematic representations of the undergarment 100 according to one embodiment in which said undergarment may include at least one fly.
Figure 8B:
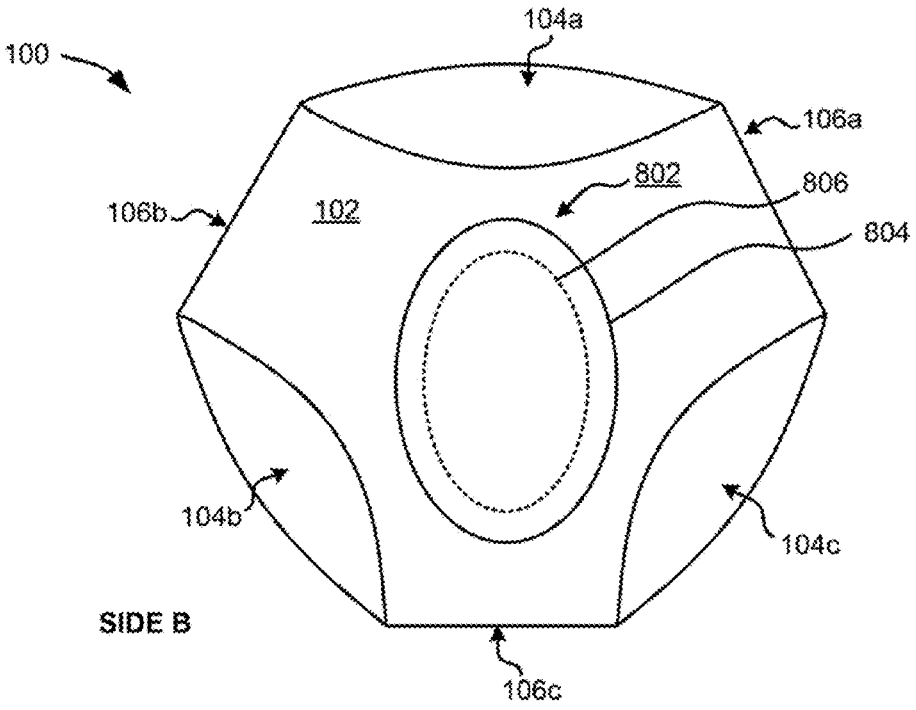

Moreover, the undergarment 100 described in any of the embodiments herein may also include an optional fly configured to allow access to the interior of the undergarment 100. FIG. 8A illustrates one embodiment in which a fly 802 may be located toward the center of Side A of the undergarment 100. A fly 802 may also be located in the same configuration on Side B of the undergarment as shown in FIG. 8B. The fly 802 may comprise an overlying panel of material 804 that substantially covers an opening (denoted by dotted line 806) in the main body 102. The opening 806 and the overlying panel of material 804 may have any suitable shape including, but not limited to, a circle, an oval, a rectangular, a square, a triangle, an irregular shape, etc. Additionally, the fly 802 may be of a sufficient size so as to allow a portion of the male genitalia to extend beyond the exterior of the undergarment 100. While not shown in FIGS. 8A-8B, the optional fly 802 may comprise, on at least one portion thereof, one or more buttons, a hook and loop fastener, a zipper, or other suitable fastening device configured to prevent exposure of the male genitalia to the exterior of the undergarment 100 when such exposure is not desired. The fly 802 is not limited to design and/or configuration shown in FIGS. 8A-8B, but may include any design and/or configuration as known in the art.

It is also of note that the undergarment 100 described in any of the embodiments herein may be comprised of one or more panels of material. Each of the one or more panels may independently comprise any of the materials described herein, a desired color or combination of colors, a desired design/print, etc.

In one particular approach, the main body 102 of the undergarment 100 may be comprised of a single piece of continuous material. In another particular approach, the main body 102 of the undergarment 100 may be comprised of two, three, four, five, six, seven, eight, nine, ten, eleven, twelve, or more panels of material.

Figure 9A:
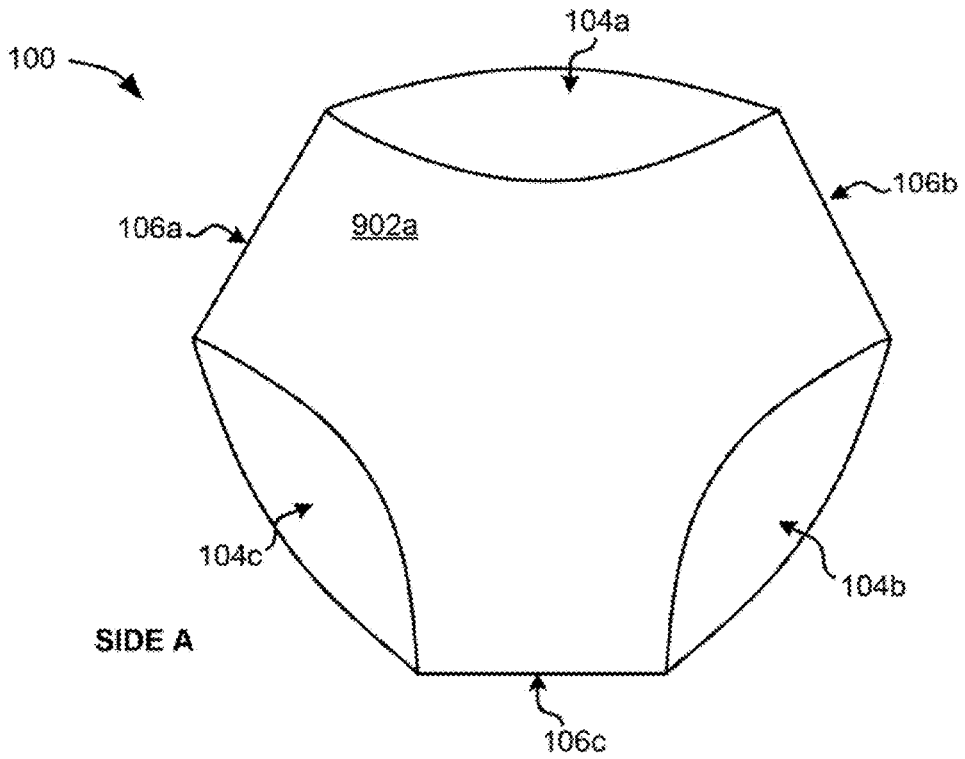
FIGS. 9A-9E are schematic representations of the undergarment 100 according to various embodiments in which said undergarment may include two panels of material 902*a*, 902*b*.
Figure 9B:
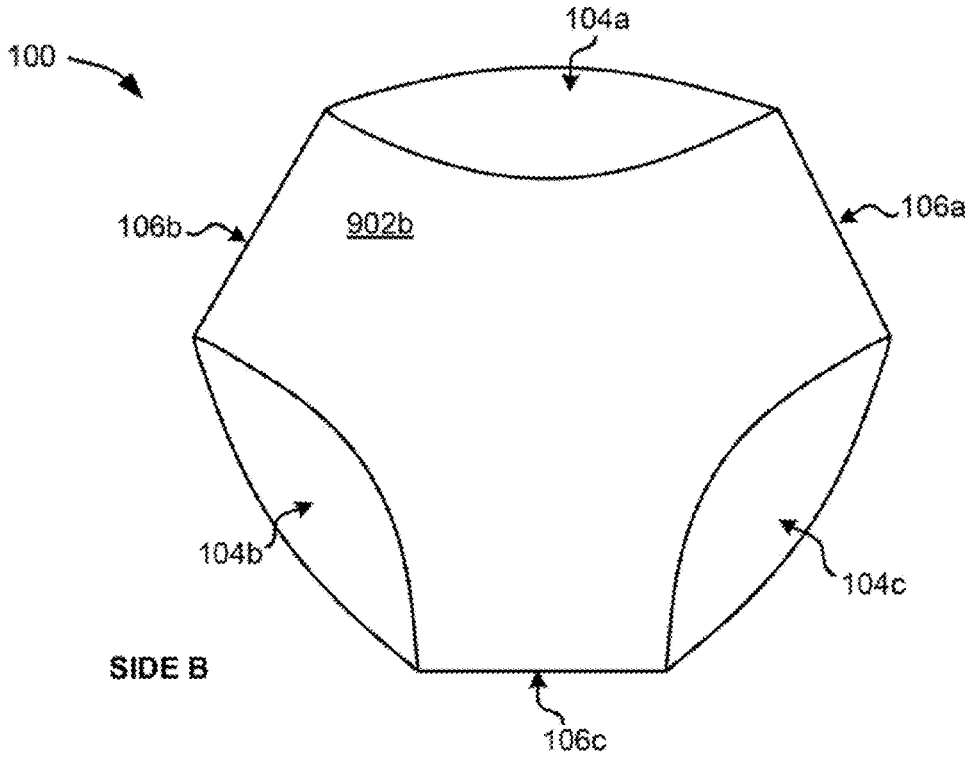
Figure 9E:
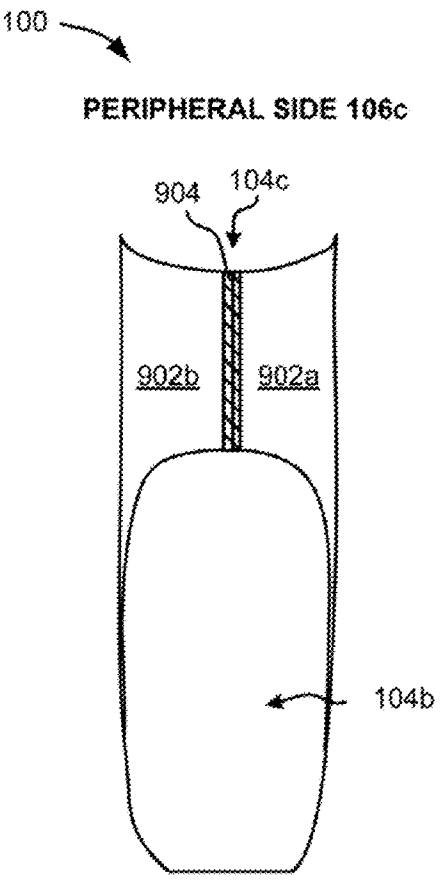
Figure 9D:
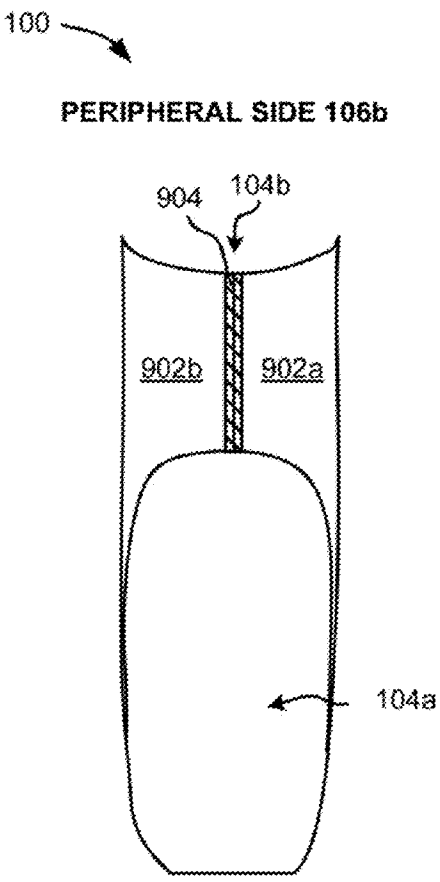
Figure 9C:
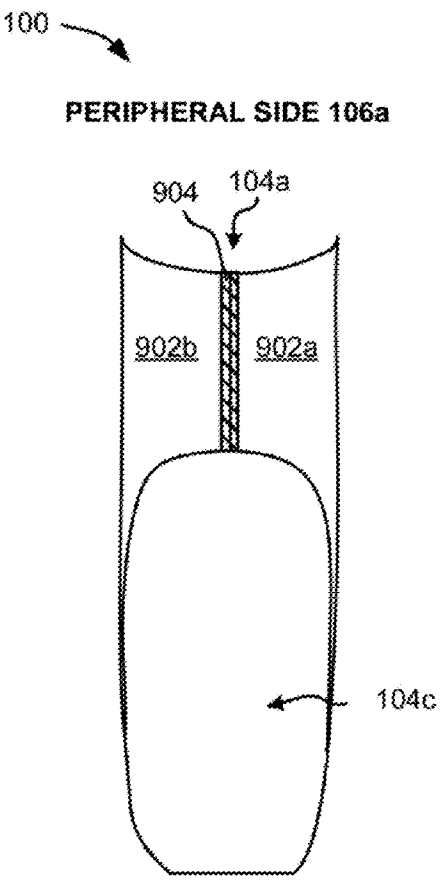

FIGS. 9A-9E illustrate an exemplary embodiment in which the undergarment 100 may include a first panel 902*a* of material and second panel 902*b* of material attached together at each of the peripheral edges 106*a*, 106*b*, 106*c*. FIGS. 9A-9B provide views of Side A and Side B, respectively, of the undergarment 100, whereas FIGS. 9C-9E provide views of the peripheral edges 106*a*, 106*b*, 106*c*, of the undergarment 100.

In some approaches, the first panel 902*a* of material may include the same material, the same color or combinations of colors, and/or the same design/print as the second panel 902*b* of material. In other approaches, the first panel 902*a* of material may include a different material, a different color or combinations of colors, and/or a different design/print as the second panel 902*b* of material.

In preferred approaches, the first and second panels 902*a*, 902*b* of material may have the same dimensions and/or properties as one another. In yet more preferred approaches, the first and second panels 902*a*, 902*b* of material may be comprised of a multi-stretch ("4-way") material, where the greatest stretch is along each of the openings 104*a*, 104*b*, 104*c*.

As particularly shown in FIGS. 9C-9E, the first and second panels 902*a*, 902*b* of material may be attached together via closures 904. In some approaches, one or more of the closures 904 may include a seam, an adhesive, Velcro®, a hook and loop fastener, or other attachment mechanism as would be recognized by one having skill in the art upon reading the present disclosure. In one approach, one or more of the closures 904 may be configured to allow a human wearer to dissemble and/or assemble the undergarment along said closures. For instance, in one exemplary approach, one or more of the closures 904 may include a hook and loop fastener, thereby allowing a human wearer to easily attach the first and second panels 902*a*, 902*b* of material at said hook and loop fastener closures.

Figure 10A:
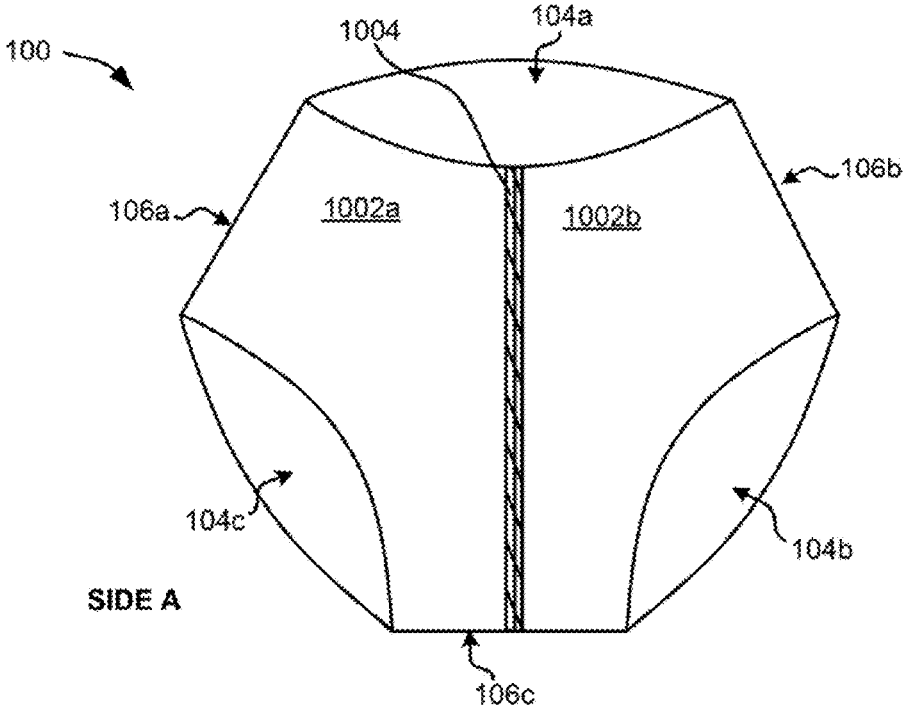
FIGS. 10A-10E are schematic representations of the undergarment 100 according to various embodiments in said undergarment may include four panels of material 1002*a*, 1002*b*, 1002*c*, 1002*d*.
Figure 10B:
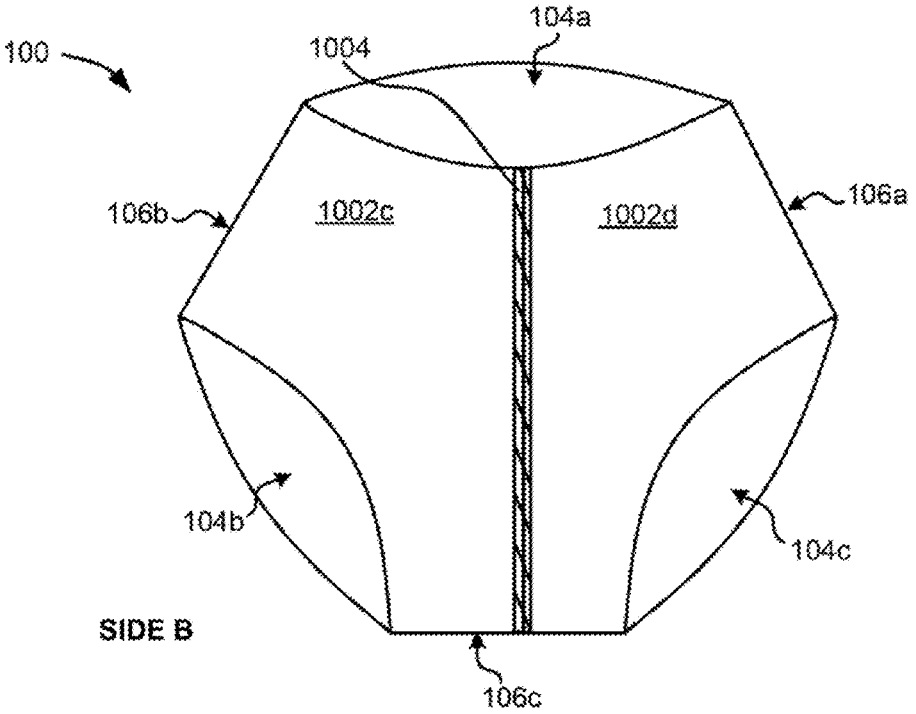
Figure 10C:
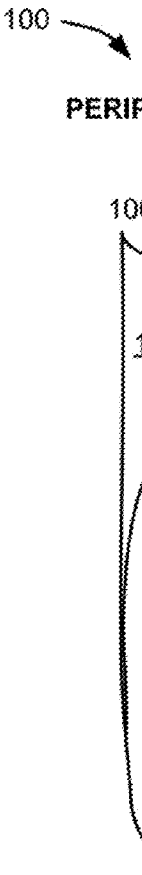
Figure 10D:
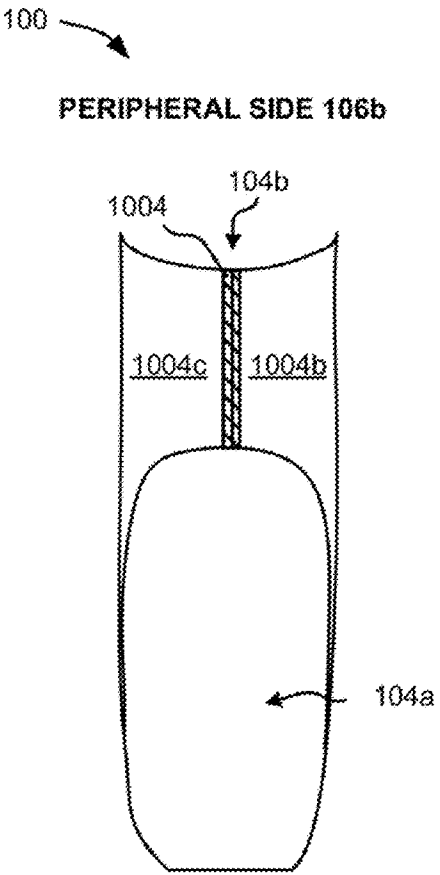
Figure 10E:
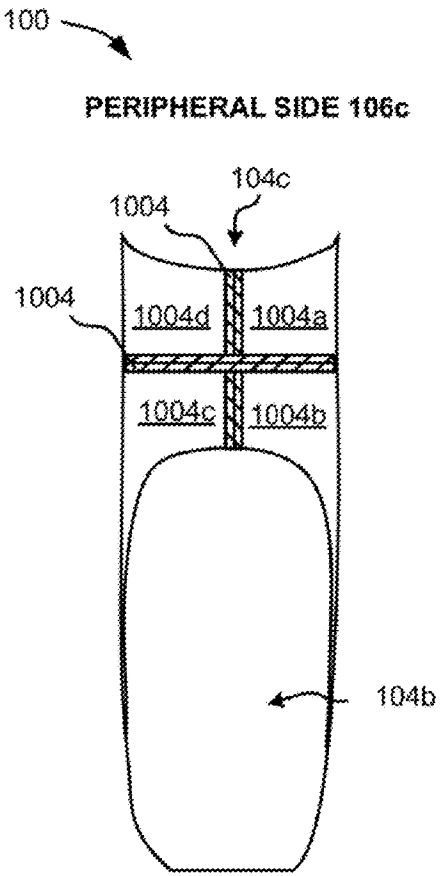

FIGS. 10A-10E illustrate an embodiment in which the undergarment 100 may include a first, second, third, and fourth panel (1002*a*, 1002*b*, 1002*c*, 1002*d*, respectively) of material. FIGS. 10A-10B provide views of Side A and Side B, respectively, of the undergarment 100, whereas FIGS. 10C-10E provide views of the peripheral edges 106*a*, 106*b*, 106*c*, of the undergarment 100.

In preferred approaches, each of the panels 1002*a*, 1002*b*, 1002*c*, 1002*d* of material may have the same dimensions and/or properties as one another.

In some approaches, at least two of the panels 1002*a*, 1002*b*, 1002*c*, 1002*d* may include the same material, the same color or combinations of colors, and/or the same design/print as each other. In other approaches, at least two of the panels 1002*a*, 1002*b*, 1002*c*, 1002*d* may include a different material, a different color or combinations of colors, and/or a different design/print as one another.

In various approaches, each of the panels 1002*a*, 1002*b*, 1002*c*, 1002*d* may be comprised of a multi-stretch ("4-way") material, where the greatest stretch is along each of the openings 104*a*, 104*b*, 104*c*.

As particularly shown in FIGS. 10A-10E, the panels 1002*a*, 1002*b*, 1002*c*, 1002*d* of material may be attached together via closures 1004. In some approaches, one or more of the closures 1004 may include a seam, an adhesive, Velcro®, a hook and loop fastener, or other attachment mechanism as would be recognized by one having skill in the art upon reading the present disclosure. In one approach, one or more of the closures 1004 may be configured to allow a human wearer to dissemble and/or assemble the undergarment along said closures. For instance, in one exemplary approach, one or more of the closures 1004 may include a hook and loop fastener, thereby allowing a human wearer to easily attach respective panels of material at said hook and loop fastener closures.

Figure 11A:
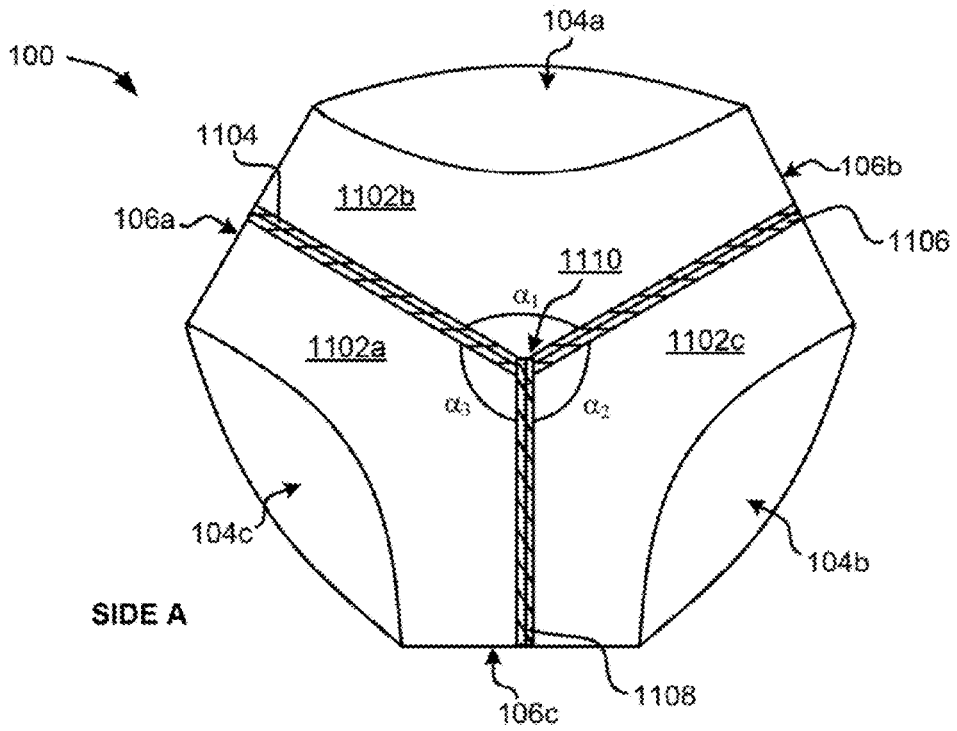
FIGS. 11A-11E are schematic representations of the undergarment 100 according to various embodiments in which said undergarment may include six panels of material 1102*a*, 1102*b*, 1102*c*, 1102*d*, 1102*e*, 1102*f*.
Figure 11B:
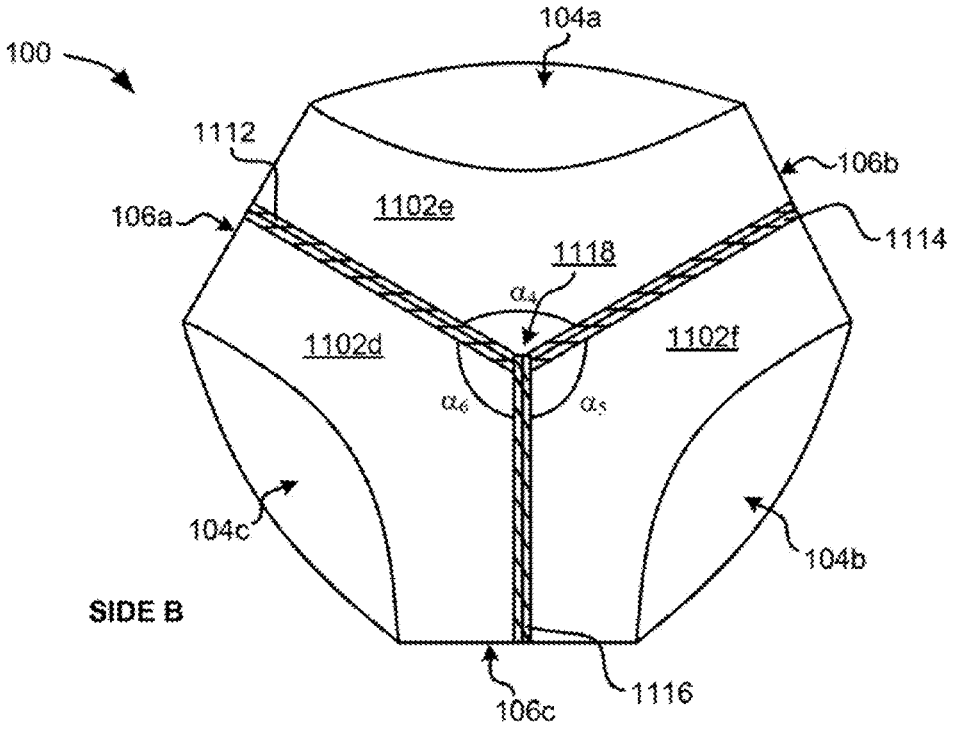
Figure 11E:
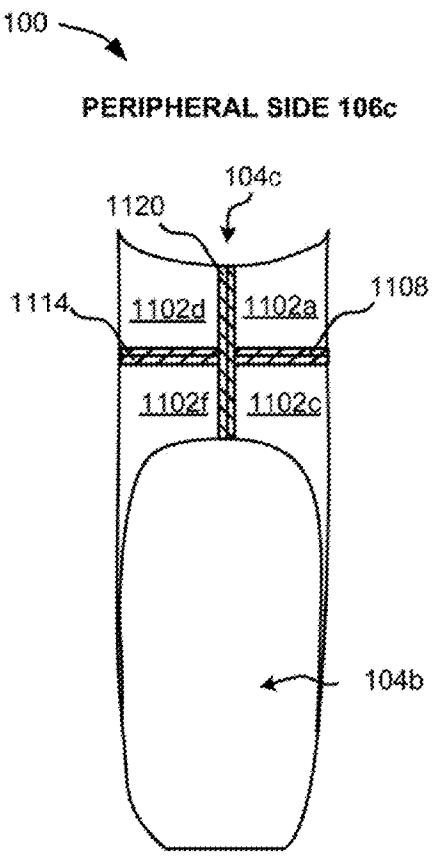
Figure 11D:
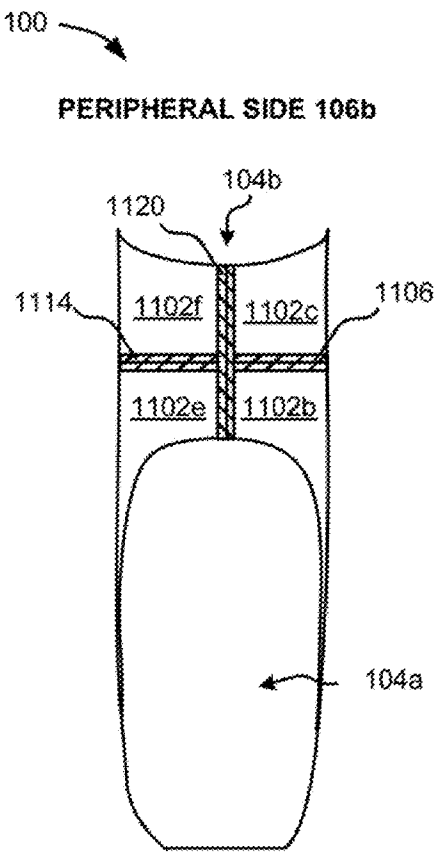
Figure 11C:
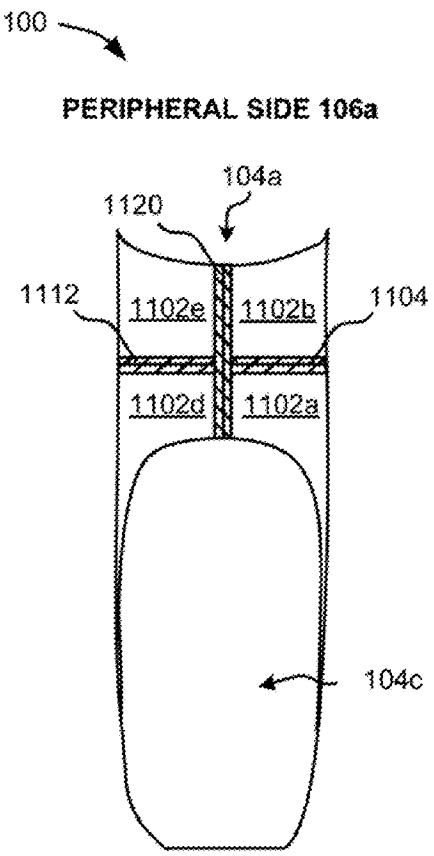

FIGS. 11A-11E illustrate an embodiment in which the undergarment 100 may include a first, second, third, fourth, fifth and sixth panel (1102*a*, 1102*b*, 1102*c*, 1102*d*, 1102*e*, 1102*f*, respectively) of material. FIGS. 11A-11B provide views of Side A and Side B, respectively, of the undergarment 100, whereas FIGS. 11C-11E provide views of the peripheral edges 106*a*, 106*b*, 106*c*, of the undergarment 100.

In various approaches, two or more of the panels 1102*a*, 1102*b*, 1102*c*, 1102*d*, 1102*e*, 1102*f* may have the same dimensions and/or properties as one another. In preferred approaches, each of the panels 1102*a*, 1102*b*, 1102*c*, 1102*d*, 1102*e*, 1102*f* of material may have the same dimensions as one another.

In some approaches, at least two of the panels 1102*a*, 1102*b*, 1102*c*, 1102*d*, 1102*e*, 1102*f* may include the same material, the same color or combinations of colors, and/or the same design/print as each other. In other approaches, at least two of the panels 1102*a*, 1102*b*, 1102*c*, 1102*d*, 1102*e*, 1102*f* may include a different material, a different color or combinations of colors, and/or a different design/print as one another.

In preferred approaches, each of the panels 1102*a*, 1102*b*, 1102*c*, 1102*d*, 1102*e*, 1102*f* may be comprised of a multi-stretch ("4-way") material, where the greatest stretch is along each of the openings 104*a*, 104*b*, 104*c*. These multi-stretch panels allow for the openings 104*a*, 104*b*, 104*c* to accommodate either a portion of the leg or torso of a human wearer by stretching out to a greater degree around the portion of his/her torso and to a lesser extent around the portion of his/her leg.

Each of the panels 1102*a*, 1102*b*, 1102*c*, 1102*d*, 1102*e*, 1102*f* of material may be attached/connected together via any suitable type of closure, including but not limited to a seam, adhesive, Velcro®, a hook and loop fastener, or other attachment mechanism as would be recognized by one having skill in the art upon reading the present disclosure. In some approaches, one or more of the aforementioned closures may be configured to allow a human wearer to dissemble and/or assemble the undergarment along said closures. For instance, in one exemplary approach, one or more of the closures may include a hook and loop fastener, thereby allowing a human wearer to easily attach respective panels of material at said hook and loop fastener closures.

As particularly shown in the embodiment of FIG. 11A, closure 1104 attaches/connects the first and second panels 1102*a*, 1102*b* of material; closure 1106 attaches/connects the second and third panels 1102*b*, 1102*c* of material; and closure 1108 attaches/connects the first and third panels 1102*a*, 1102*c* of material. The closures 1104, 1106, 1108 may, but need not, intersect at the intersection point 1110 located at the center of the side of main body 102 shown in FIG. 11A.

As also shown in FIG. 11A, the angle $\alpha_1$ is formed by closures 1104 and 1106; the angle $\alpha_2$ is formed by closures 1106 and 1108; and the angle $\alpha_3$ is formed by closures 1108 and 1104. In various approaches, each of the angles $\alpha_1$, $\alpha_2$, $\alpha_3$ may be equal to one another. In other approaches, at least two of the angles $\alpha_1$, $\alpha_2$, $\alpha_3$ may be the same. In yet other approaches, each of the angles $\alpha_1$, $\alpha_2$, $\alpha_3$ may be different from one another. In further approaches, at least two of the angles $\alpha_1$, $\alpha_2$, $\alpha_3$ may be different from one another.

In a particular approach, each of the angles $\alpha_1$, $\alpha_2$, $\alpha_3$ may independently be in a range from about 45 degrees to about 160 degrees. In a preferred approach, each of the angles $\alpha_1$, $\alpha_2$, $\alpha_3$ may be about 120 degrees.

Referring now to FIG. 11B, closure 1112 attaches/connects the fourth and fifth panels 1102*d*, 1102*e* of material; closure 1114 attaches/connects the fifth and sixth panels 1102*e*, 1102*f* of material; and closure 1116 attaches/connects the fourth and sixth panels 1102*d*, 1102*f* of material. The closures 1112, 1114, 1116 may, but need not, intersect at the intersection point 1118 located at the center of the side of main body 102 shown in FIG. 11B. As also shown in FIG. 11B, the angle $\alpha_4$ is formed by closures 1112 and 1114; the angle $\alpha_5$ is formed by closures 1114 and 1116; and the angle $\alpha_6$ is formed by closures 1116 and 1112. In various approaches, each of the angles $\alpha_4$, $\alpha_5$, $\alpha_6$ may be equal to one another. In other approaches, at least two of the angles $\alpha_4$, $\alpha_5$, $\alpha_6$ may be the same. In yet other approaches, each of the angles $\alpha_4$, $\alpha_5$, $\alpha_6$ may be different from one another. In further approaches, at least two of the angles $\alpha_4$, $\alpha_5$, $\alpha_6$ may be different from one another.

In a particular approach, each of the angles $\alpha_4$, $\alpha_5$, $\alpha_6$ may independently be in a range from about 45 degrees to about 160 degrees. In a preferred approach, each of the angles $\alpha_4$, $\alpha_5$, $\alpha_6$ may be about 120 degrees.

As particularly shown in FIGS. 11C-11E, each of the peripheral edges 106*a*, 106*b*, 106*c* may include a peripheral edge closure 1120.

The inventive concepts disclosed herein have been presented by way of example to illustrate the myriad features thereof in a plurality of illustrative scenarios, embodiments, and/or implementations. It should be appreciated that the concepts generally disclosed are to be considered as modular, and may be implemented in any combination, permutation, or synthesis thereof. In addition, any modification, alteration, or equivalent of the presently disclosed features, functions, and concepts that would be appreciated by a person having ordinary skill in the art upon reading the instant descriptions should also be considered within the scope of this disclosure.

While various embodiments have been described above, it should be understood that they have been presented by way of example only, and not limitation. Thus, the breadth and scope of an embodiment of the present invention should not be limited by any of the above-described exemplary embodiments, but should be defined only in accordance with the following claims and their equivalents.

What is claimed is:

1. An undergarment, comprising:

a main body comprising at least one panel of material, wherein the at least one panel of material comprises a stretchable material;

three openings, wherein all three openings have equal dimensions, and wherein the main body further comprises an additional stretchable material near at least one of the openings; and three peripheral edges, whereon one peripheral edge is located between adjacent openings, wherein the three peripheral edges have equal dimensions.

2. The undergarment as recited in claim 1, wherein the three openings and the three peripheral edges define an outer periphery of the main body.

3. The undergarment as recited in claim 1, wherein the stretchable material comprises one or more elastomeric fibers present in an amount ranging from about 10 wt. % to about 100 wt. %, wherein the one or more elastomeric fibers are selected from the group consisting of: spandex, lastol, natural rubber, synthetic rubber, and combinations thereof.

4. The undergarment as recited in claim 1, wherein the main body further comprises one or more additives selected from the group consisting of: colorants, pigments, crosslinking agents, phase change materials, antimicrobial materials, chlorine degradation resistant materials, fragrances, insect repellants, materials configured to provide UV protection, anti-static agents, wetting agents, and combinations thereof.

5. The undergarment as recited in claim 1, wherein the additional stretchable material includes an elastic band.

6. The undergarment as recited in claim 1, wherein the main body comprises at least one cinching device near at least one of the openings, wherein the at least one cinching device is configured to alter a size of the opening.

7. The undergarment as recited in claim 1, wherein the main body comprises at least two panels of material, wherein the two panels of material are attached at each of the peripheral edges via a closure.

8. The undergarment as recited in claim 7, wherein each of the two panels of material comprise a multi-stretch material.

9. The undergarment as recited in claim 8, wherein the two panels of material have equal dimensions.

10. The undergarment as recited in claim 7, wherein the closure is a hook and loop fastener.

11. The undergarment as recited in claim 1, wherein the main body comprises at least six panels of material.

12. The undergarment as recited in claim 11, wherein each of the six panels of material comprise a multi-stretch material.

13. The undergarment as recited in claim 12, wherein the six panels of material have equal dimensions.

14. The undergarment as recited in claim 11, wherein at least one of the panels of material is connected to at least another of the panels of material via a hook and loop fastener.

15. The undergarment as recited in claim 1, wherein at least one of the peripheral edges comprises an identification label coupled thereto.

16. The undergarment as recited in claim 1, wherein all three of the openings have a length in a range from about 1.5 inches to about 60 inches.

17. The undergarment as recited in claim 1, wherein all three of the peripheral edges have a length in a range from about 1 inch to about 30 inches.

* * * * *